US012024813B1

(12) United States Patent
Al-Amri

(10) Patent No.: US 12,024,813 B1
(45) Date of Patent: Jul. 2, 2024

(54) STEAM GENERATION AND STEAM RECYCLING STEAM PRESS SYSTEM

(71) Applicant: Imam Abdulrahman Bin Faisal University, Dammam (SA)

(72) Inventor: Fahad G. Al-Amri, Dammam (SA)

(73) Assignee: Imam Abdulrahman Bin Faisal University, Dammam (SA)

( * ) Notice: Subject to any disclaimer, the term of this patent is extended or adjusted under 35 U.S.C. 154(b) by 0 days.

(21) Appl. No.: 18/599,459

(22) Filed: Mar. 8, 2024

Related U.S. Application Data

(63) Continuation of application No. 17/741,912, filed on May 11, 2022, now Pat. No. 11,982,045.

(51) Int. Cl.
*D06F 71/34* (2006.01)
*F28B 3/06* (2006.01)

(52) U.S. Cl.
CPC ..... *D06F 71/34* (2013.01); *F28B 3/06* (2013.01)

(58) Field of Classification Search
CPC ..... D06F 71/34; F28B 31/06
See application file for complete search history.

(56) References Cited

U.S. PATENT DOCUMENTS 2,372,852 A * 4/1945 Randall ..... D06F 71/32 74/520
2,931,546 A * 4/1960 Brunier ..... D06F 71/34 38/17
3,722,115 A * 3/1973 Hanson ..... D06F 71/16 38/21
4,173,300 A 11/1979 Sanko
4,189,350 A 2/1980 Yanagi
4,480,398 A 11/1984 Frushtick
8,816,865 B1 * 8/2014 Deacon ..... G01N 25/60 340/603
2011/0000281 A1 * 1/2011 Deacon ..... G01N 25/60 73/25.04
2022/0074123 A1 3/2022 Jang
2023/0366142 A1 * 11/2023 Al-Amri ..... D06F 71/34

FOREIGN PATENT DOCUMENTS

CN 2623056 Y 7/2004
CN 101967748 A 2/2011
CN 203834262 U 9/2014
(Continued)

*Primary Examiner* — Ismael Izaguirre
(74) *Attorney, Agent, or Firm* — Oblon, McClelland, Maier & Neustadt, L.L.P.

(57) ABSTRACT

A steam press system and methods of controlling steam generation and recycling steam therein are provided. The steam press system includes a first steam plate and a second steam plate configured to receive and evacuate steam. The steam press system further includes a first pump configured to draw steam from the first steam plate and the second steam plate, a heat exchanger configured to condense the steam into fresh water and heat the fresh water. The steam press system further includes a third pump to pump the heated water into a storage tank. The steam press system further includes a fourth pump configured to pump the heated water from the storage tank to a steam generator. The steam generator is configured to receive the heated water, boil the heated water to generate steam and to deliver the steam to the first steam plate and the second steam plate.

16 Claims, 17 Drawing Sheets

(56) References Cited

FOREIGN PATENT DOCUMENTS

| | | | |
|---|---|---|---|
| CN | 204825442 | U | 12/2015 |
| CN | 206204654 | U | 5/2017 |
| CN | 207958816 | U | 10/2018 |
| CN | 109629214 | A | 4/2019 |
| CN | 211256302 | U | 8/2020 |
| CN | 214496834 | U | 10/2021 |
| CN | 114032666 | A | 2/2022 |
| JP | 2012-037205 | A | 2/2012 |
| JP | 2012-041809 | A | 3/2012 |

* cited by examiner

STEAM GENERATION AND STEAM RECYCLING STEAM PRESS SYSTEM

CROSS-REFERENCE TO RELATED APPLICATIONS

The present application is a Continuation of U.S. application Ser. No. 17/741,912, now allowed, having a filing date of May 11, 2022.

BACKGROUND

Technical Field

The present disclosure is directed to a steam press for ironing clothes and, more particularly, to a steam press system and methods of controlling steam generation and recycling steam therein.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Conventional steam ironing machines include ironing boards defined by multiple holes to deliver steam. Steam may be generated by a steam generator that works in conjunction with a water pump for feeding a boiler of the steam generator, and a pipe network to supply water and generated steam. In an ironing operation, the steam is generated continuously in the boiler and delivered to the ironing boards where heat associated with the steam aids removal of wrinkles and provides a professional press appearance to garments. Steam ironing machines may also include a suction pump controlled by a foot pedal or the like, to regulate the vacuum pressure required to remove the steam from the garments and the boards. Thereafter, residual steam is rejected to a drain by the suction pump. Typically, the steam generators consume power in a range from 8 kW to 18 kW and the daily water consumption of a medium size commercial steam ironing machine ranges from 200 to 500 liters. Considering that a plurality of such commercial steam ironing machines operate in laundries and hotels worldwide, a large amount of electricity and water is consumed for steam generation during operation thereof.

CN206204654U describes a clothes steam ironing equipment with steam recycling function which includes a heat absorbing box with a radiating pipe connected to a waste steam inlet pipe that heats cold water, and reclaimed steam enters a heat sink pipe in the heat absorption box, surrounded by a heat sink. However, this publication does not describe ironing plates or a control system which uses the readings from pressure sensor(s) and/or temperature sensor (s) to render the steam and heat generation and reclamation process efficient.

CN109629214A describes a pressing/ironing box having a pressing plate which moves over the clothing on a pressing table; a hood over the pressing table collects waste heat that is used to preheat cold water entering a preheating box; a heating box that generates the steam; and a computer that controls the operation of switches, a water pump, an air pump, and valves. This publication fails to describe aspects of steam reclamation and the use of sensor(s) to render the process efficient.

CN207958816U describes an industrial iron capable of recycling steam, including a steam generator and a steam recovery device which supplies preheated water to the steam generator; a tube through the steam recovery device which exchanges heat with the recycled steam to warm the water. CN211256302U describes a steam reclaiming iron in which the steam is recycled to preheat cold incoming water before the cold water is supplied to a heater. However, both CN207958816U and CN211256302U do not mention a computer control, or details of a heat exchanger, pressure valves, temperature sensors and controls.

As such, each of the aforementioned references suffers from one or more drawbacks hindering their adoption. Accordingly, it is one object of the present disclosure to provide system and methods of controlling steam generation and recycling the steam and heat contained within and used during pressing operations by using controlled procedures to render the steam and heat generation process and steam reclamation process efficient.

SUMMARY

In an exemplary embodiment, a steam press system is provided. The steam press system includes a first steam plate configured to receive steam at a first steam plate inlet and evacuate the steam through a first steam plate outlet. The steam press system also includes a second steam plate configured to receive steam at a second steam plate inlet and evacuate the steam through a second steam plate outlet. The steam press system further includes a first piping arrangement connected to the first steam plate outlet and the second steam plate outlet. The steam press system further includes a first pump connected to the first piping arrangement. The first pump is configured to draw steam from the first piping arrangement and expel the steam at a first pump outlet. The steam press system further includes a heat exchanger having a first heat exchanger inlet port connected to the first pump outlet. The steam press system further includes a second pump configured to pump fresh water at a first temperature from a freshwater source into a second heat exchanger inlet port. The heat exchanger is configured to condense the steam into the fresh water and heat the fresh water to a second temperature greater than the first temperature. The steam press system further includes a heat exchanger outlet port configured to expel the heated water. The steam press system further includes a third pump connected to the heat exchanger outlet port. The steam press system further includes a storage tank inlet connected to the third pump. The steam press system further includes a fourth pump connected to a storage tank outlet. The steam press system further includes a steam generator having a steam generator inlet connected to the fourth pump. The steam generator is configured to receive the heated water at the second temperature from the fourth pump. The steam generator is further configured to boil the heated water to generate steam at a third temperature. The steam generator is further configured to deliver the steam to the first steam plate inlet and the second steam plate inlet through a second piping arrangement.

In another exemplary embodiment, a method of recycling steam in a steam press is provided. The method includes receiving recycled steam, from a first pump connected to a first steam plate outlet and a second steam plate outlet, into a first heat exchanger inlet port. The method further includes pumping, with a second pump connected to a freshwater source, fresh water at a first temperature into a second heat exchanger inlet port. The method further includes expelling the recycled steam from a swirl generator connected to the first heat exchanger inlet port, thus imparting a swirling flow in the fresh water which mixes the recycled steam with the fresh water, generating mixed water having a second temperature higher than the first temperature, the second temperature in a range of 90 degrees to 100 degrees. The method further includes pumping, with a third pump, the mixed water at the second temperature from a heat exchanger outlet port to a storage tank. The method further includes pumping, with a fourth pump, the mixed water at the second temperature to a steam generator. The method further includes heating, by providing power to a resistive heating element located in the steam generator, the mixed water at the second temperature to boiling, generating steam at third temperature. The method further includes delivering, by a controllable pressure valve, the steam at the third temperature to a first steam plate inlet and a second steam plate inlet.

In yet another exemplary embodiment, a method of controlling steam generation in a steam press is provided. The method includes pumping recycled steam from a first pump connected to a first steam plate outlet and a second steam plate outlet, into a first heat exchanger inlet port. The method further includes pumping, by a second pump, fresh water at a first temperature, into a second heat exchanger inlet port. The method further includes mixing the steam with fresh water at the first temperature in the heat exchanger with the recycled steam by a swirl generator, generating mixed water at a second temperature higher than the first temperature. The method further includes pumping, by a third pump, the mixed water through a check valve into a storage tank. The method further includes pumping, by a fourth pump, the mixed water from the storage tank into a steam generator. The method further includes heating, by providing power to a resistive heating element of a steam generator heating circuit located in the steam generator, the mixed water at the second temperature to boiling, thus generating steam at a third temperature. The method further includes pressing a first foot pedal to actuate a controllable pressure valve located at the steam generator outlet, to deliver the steam at the third temperature to a first steam plate inlet and a second steam plate inlet. The method further includes heating, by resistive heating or inductive heating, the steam within the first steam plate and the second steam plate to a fourth temperature higher than the third temperature. The method further includes pressing a second foot pedal to actuate the first pump to evacuate the steam from the first steam plate outlet and the second steam plate outlet. The method further includes measuring the first, second, third and fourth temperatures with first, second, third and fourth temperature sensors respectively. The method further includes measuring, by a first pressure sensor and a second pressure sensor connected between the first steam plate outlet and the first pump, a third pressure sensor located at the steam generator outlet, a fourth pressure sensor located at the second heat exchanger inlet port and a fifth pressure sensor located at the heat exchanger outlet port, a first, second, third, fourth and fifth pressure respectively. The method further includes measuring, by an ultrasonic water level sensor, a water level reading in the heat exchanger. The method further includes controlling the steam generation and recycling of the steam, by a controller connected to the first, second, third and fourth temperature sensors, the first, second, third, fourth and fifth pressure sensors, the ultrasonic water level sensor, the controllable pressure valve, and the steam generator heating circuit. The controller including a non-transitory computer readable medium having instructions stored therein that, when executed by one or more processors, cause the one or more processors to: monitor the water level reading in the heat exchanger; compare the water level to a water level threshold; monitor the first, second, third, and fourth temperatures; monitor the first, second, third, fourth and fifth pressures; compare the first, second, third, and fourth temperatures to a first set of temperature setpoint values; compare the first, second, third, fourth and fifth pressures to a second set of pressure setpoint values; and generate control signals to adjust the first pump, the second pump, the third pump, the fourth pump, the controllable pressure valve, and a power supplied to the steam generator heating circuit to cause the first, second, third, and fourth temperatures to match the first set of temperature setpoint values and the first, second, third, fourth and fifth pressures to match the second set of pressure setpoint values.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
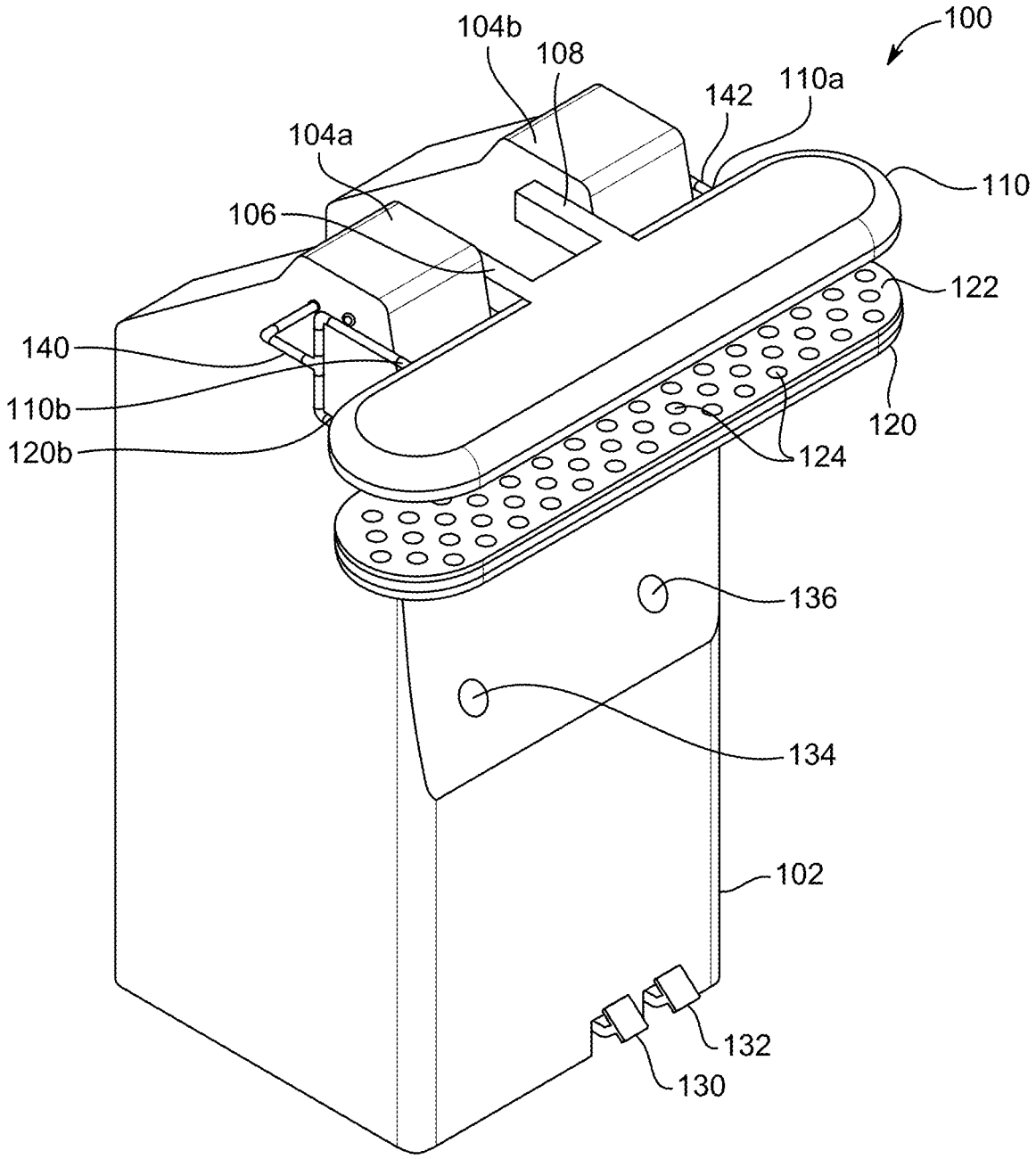
FIG. 1 is a diagrammatic perspective view of a steam press system, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Aspects of the present disclosure are directed to a steam press system and methods of controlling steam generation and recycling steam therein. The steam press system includes a steam generator to deliver the steam to steam plates for ironing and steaming clothes, a suction pump to take out moisture and rejected steam from the steam plates, and a heat exchanger to exchange heat between the rejected steam and incoming fresh water to be passed to the steam generator. Water level control and pressure control are integrated into the steam generator. The steam press system allows recovery of heat from the rejected steam and uses the steam to heat the incoming fresh water before it enters the steam generator. As such, the steam generator requires minimal energy to convert the pre-heated water into steam. Further, the rejected steam and heat of the steam is captured and condensed in the heat exchanger, and subsequently recycled by the steam press system. Thus, the steam press system may reduce energy consumption and achieve a significant reduction in use of water.

Referring to FIG. 1, a perspective view of a steam press system 100 is illustrated, according to an embodiment of the present disclosure. The steam press system 100 includes an outer case 102. The outer case 102 is embodied as a cabinet having a predetermined volume to house various components of the steam press system 100. Although in the illustrated example, the outer case 102 is shown as a cuboidal structure, it will be appreciated that, in other examples, the outer case 102 may have any other suitable shape (such as cylindrical). In some examples, the outer case 102 may be made of suitable materials to withstand high temperatures, such as, but not limited to, a high performance polymer including polytetrafluoroethylene (PTFE), austenitic stainless steels, and the like. In some examples, the outer case 102 may include an insulation layer to prevent loss of heat therefrom and to prevent accidental heat shock to a user operating the steam press system 100.

The steam press system 100 includes a first steam plate 110 and a second steam plate 120. The first steam plate 110 and the second steam plate 120 are coupled to the outer case 102. Specifically, the first steam plate 110 and the second steam plate 120 are coupled to protrusions 104*a*, 104*b* of the outer case 102. As shown, the protrusions 104*a*, 104*b* extend in a vertical direction from a top portion of the outer case 102. The steam press system 100 also includes two struts, such as a first strut 106 and a second strut 108, each extending from the first steam plate 110. In some embodiments, the second steam plate 120 may be coupled to the outer case 102 with help of similar struts (not shown in FIG. 1). Preferably, the second steam plate 120 is arranged vertically below the first steam plate 110 and the second steam plate 120 is stationary. In one embodiment, the first strut 106 and the second strut 108 may be pivotally coupled to the respective protrusions 104*a*, 104*b*, to allow angular movement of the first steam plate 110 with respect to the second steam plate 120. In such arrangement, each of the first strut 106 and the second strut 108 may be coupled to the first steam plate 110 via a ball joint (not shown) to allow flexible movement on the first steam plate 110 by the user. The ball joint may allow the first steam plate 110 to be held parallel with respect to the second steam plate 120 when the first steam plate 110 is moved in an arcuate direction with respect to the second steam plate 120. Further, each of the protrusions 104*a*, 104*b* may include a stopper (not shown) to restrict such angular movement of the first strut 106 and the second strut 108 beyond a predetermined angle. In some embodiments, each of the protrusions 104*a*, 104*b* may include a mechanism (not shown) to retain the first steam plate 110 at a desired angular position while the steam press system 100 is being used by the user. Such mechanism may add to the convenience of the user while the user replaces a garment to be ironed or changes a side of the garment to be ironed. Additionally, such mechanism may add to the comfort of a taller or a shorter user by allowing a higher or lower positioning of the upper steam plate.

In another embodiment, the first steam plate 110 may be connected to the protrusions 104*a*, 104*b* by, for example, a prismatic joint, such as a slider or the like, to allow vertical movement (downwards and upwards) of the first steam plate 110 in a direction towards or away with respect to the second steam plate 120.

Figure 2:
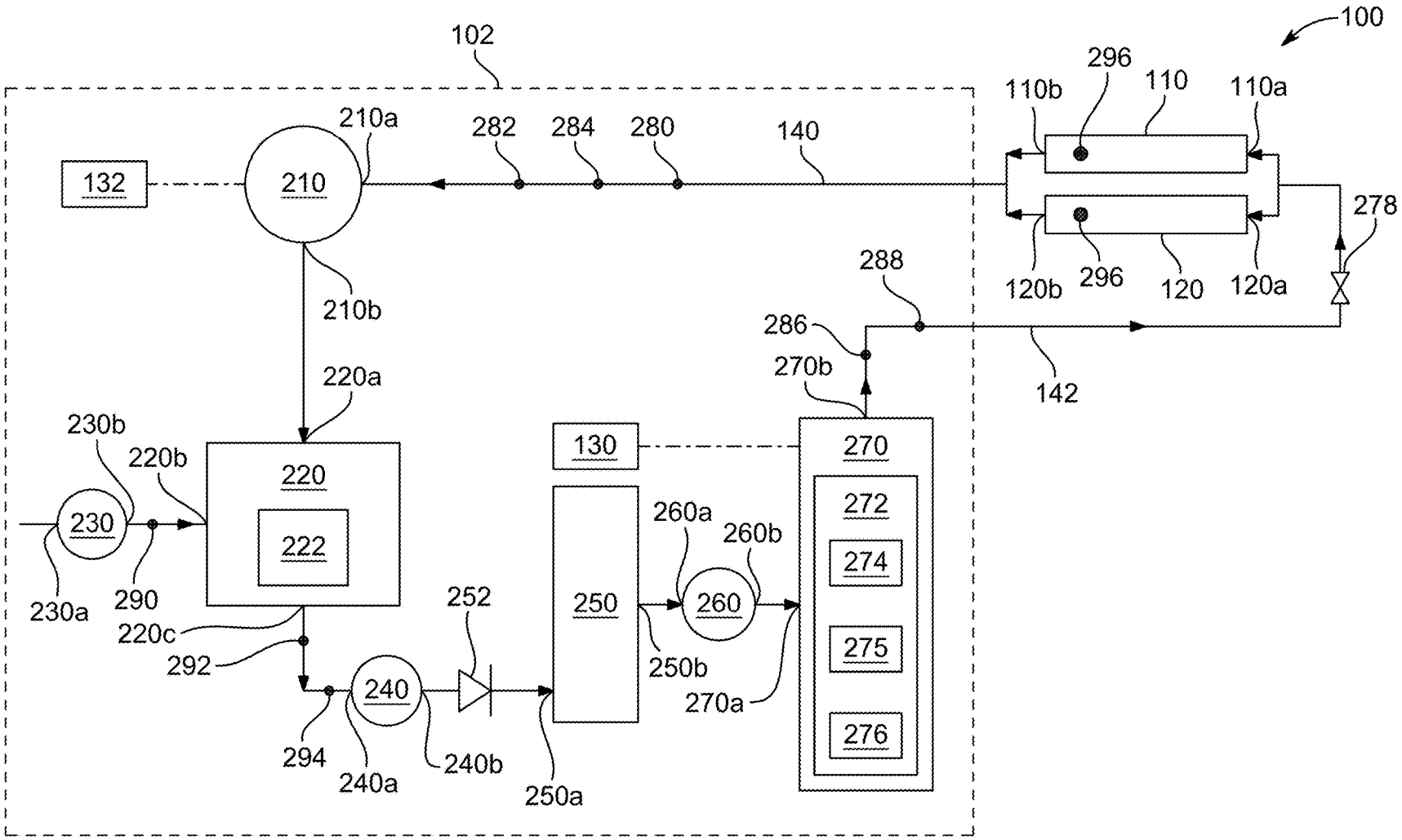
FIG. 2 is a schematic diagram of the steam press system of FIG. 1, according to certain embodiments.

Each of the first steam plate 110 and the second steam plate 120 includes an inlet and an outlet to, respectively, receive and evacuate steam therefrom. In particular, the first steam plate 110 includes a first steam plate inlet 110*a* and a first steam plate outlet 110*b*, and the second steam plate 120 includes a second steam plate inlet 120*a* (as shown in FIG. 2, not visible in FIG. 1) and a second steam plate outlet 120*b* (generally labelled in FIG. 1 and more clearly shown in FIG. 2). The first steam plate 110 is configured to receive steam at the first steam plate inlet 110*a* and vent the steam through the first steam plate outlet 110*b*. Similarly, the second steam plate 120 is configured to receive steam at the second steam plate inlet 120*a* and vent the steam through the second steam plate outlet 120*b*.

Figure 8A:
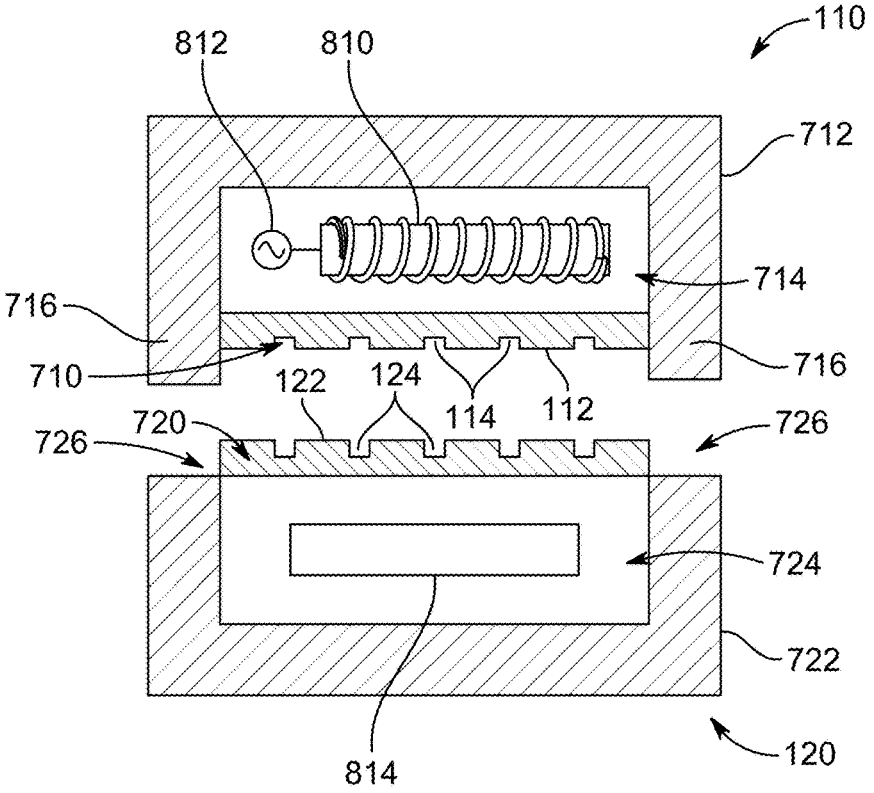
FIG. 8A is an exemplary cross-sectional view of steam plates of the steam press system of FIG. 7, according to one embodiment.
Figure 8B:
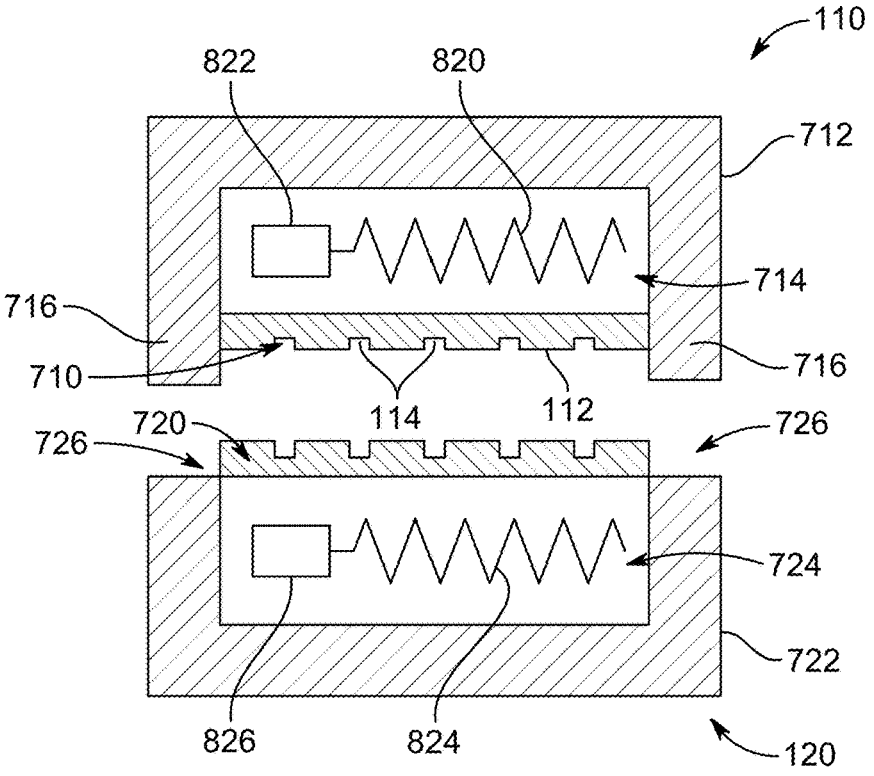
FIG. 8B is an exemplary cross-sectional view of steam plates of the steam press system of FIG. 7, according to another embodiment.

Further, the first steam plate 110 includes a first inner surface 112 (as shown in FIGS. 8A and 8B, not visible in FIG. 1) and the second steam plate 120 includes a second inner surface 122. The first inner surface 112 of the first steam plate 110 faces the second inner surface 122 of the second steam plate 120. In an example, the first inner surface 112 and the second inner surface 122 are made from iron. In another example, the first inner surface 112 and the second inner surface 122 are made from one of anodized aluminum, titanium alloy, stainless steel, porcelain, satin aluminum, polished aluminum, ceramic, and titanium. These materials exhibit excellent heat conducting capability, aid in the even distribution of heat, prevent or eliminate static, provide a smooth surface, prevent the garment from sticking to the surface, and require minimum maintenance. In the steam press system 100, each of the first inner surface 112 and the second inner surface 122 includes a pattern of holes (such as an array) distributed evenly. The first inner surface 112 of the first steam plate 110 define holes 114 (as shown in FIGS. 8A and 8B, not visible in FIG. 1) and the second inner surface 122 of the second steam plate 120 define holes 124. Each of the holes 114 in the first steam plate 110 and each of the holes 124 in the second steam plate 120 are configured to supply the steam, such that the garment placed between the first steam plate 110 and the second steam plate 120 may absorb the supplied steam from both sides, which in turn may aid in the ironing of the garment.

The steam press system 100 also includes a first foot pedal 130 and a second foot pedal located at a bottom portion of the outer case 102, at a front side thereof. The first foot pedal 130 and the second foot pedal 132 are operated by the foot of the user. In some embodiments, the first foot pedal 130 and the second foot pedal 132 may be used to regulate the flow of steam. Further, the steam press system 100 may include a temperature control switch 134 and a pressure control switch 136 provided on the outer case 102. As shown, the temperature control switch 134 and the pressure control switch 136 may be located on the front side of the outer case 102 so as to be accessible to the user. In an embodiment, the temperature control switch 134 and the pressure control switch 136 may be actuatable by a knee of the user. The temperature control switch 134 and the pressure control switch 136 may be configured to regulate the temperature and the pressure of the steam. In some embodiments, a display screen (not shown) may be provided on the outer case 102 to display values of the temperature and the pressure being set by the user via the temperature control switch 134 and the pressure control switch 136, respectively. In some embodiments, the display screen may be a touchscreen configured to allow the user to select a type of material of the garment, such as cotton, silk, etc., and the value of the temperature and the pressure of the steam may be set automatically based on the type of the material.

FIG. 2 illustrates a schematic diagram of the steam press system 100 showing a block diagram of components housed within the outer case 102. Referring to FIG. 1 and FIG. 2 in combination, the steam press system 100 includes a first piping arrangement 140 connected to the first steam plate outlet 110*b* and the second steam plate outlet 120*b*. The steam press system 100 also includes a second piping arrangement 142 connected to the first steam plate inlet 110*a* and the second steam plate inlet 120*a*. As illustrated in FIG. 2, the steam press system 100 further includes a first pump 210 connected to the first piping arrangement 140, a heat exchanger 220, a second pump 230, a third pump 240, a storage tank 250, a fourth pump 260 and a steam generator 270 connected to the second piping arrangement 142. The first pump 210 has a first pump inlet 210*a* and a first pump outlet 210*b*; the heat exchanger 220 has a first heat exchanger inlet port 220*a*, a second heat exchanger inlet port 220*b* and a heat exchanger outlet port 220*c*; the second pump 230 has a second pump inlet 230*a* and a second pump outlet 230*b*; the third pump 240 has a third pump inlet 240*a* and a third pump outlet 240*b*; the storage tank 250 has a storage tank inlet 250*a* and a storage tank outlet 250*b*; the fourth pump 260 has a fourth pump inlet 260*a* and a fourth pump outlet 260*b*; and the steam generator 270 has a steam generator inlet 270*a* and a steam generator outlet 270*b*. The first pump inlet 210*a* is connected to the first steam plate outlet 110*b* and the second steam plate outlet 120*b* via the first piping arrangement 140, and the first pump outlet 210*b* is connected to the first heat exchanger inlet port 220*a*. Further, the second pump inlet 230*a* is connected to a freshwater source, such as a reservoir (not shown) or cold water pipe (not shown), and the second pump outlet 230*b* is connected to the second heat exchanger inlet port 220*b*. Further, the third pump inlet 240*a* is connected to the heat exchanger outlet port 220*c* and the third pump outlet 240*b* is connected to the storage tank inlet 250*a*. Further, the fourth pump inlet 260*a* is connected to the storage tank outlet 250*b* and the fourth pump outlet 260*b* is connected to the steam generator inlet 270*a*. Additionally, the steam generator outlet 270*b* is connected to the first steam plate inlet 110*a* and the second steam plate inlet 120*a* via the second piping arrangement 142.

The first pump 210, the heat exchanger 220, the second pump 230, the third pump 240, the storage tank 250, the fourth pump 260 and the steam generator 270 are enclosed within the outer case 102. However, in other examples, one or more of these components may be located outside of the outer case 102 and suitably connected to remaining component(s) housed inside the outer case 102. It may also be understood (and as may be seen from FIG. 1) that the first piping arrangement 140 and the second piping arrangement 142 may be located partially outside the outer case 102 to be connected to the steam plates 110, 120, and may be located partially inside the outer case 102 to be connected to the first pump 210 and the steam generator 270, respectively. The first piping arrangement 140 and the second piping arrangement 142 may extend from openings defined in the outer case 102, or in the protrusions 104*a*, 104*b* of the outer case 102. In the illustrated embodiment, the openings are defined on lateral sides of the protrusions 104*a*, 104*b*. However, alternatively, the openings may be formed at front sides of the protrusions 104*a*, 104*b* of the outer case 102, facing the first steam plate 110 and the second steam plate 120. Each of the first piping arrangement 140 and the second piping arrangement 142 is configured to allow flow of steam therethrough and hence may be at high temperatures. In some embodiments, portions of the first piping arrangement 140 and the second piping arrangement 142 exposed to the outside of the outer case 102 may be insulated (i.e., provided with an insulating layer) to prevent burns due to accidental touching by the user while operating the steam press system 100.

In some embodiments, the various components of the steam press system 100 may work in conjunction with one another to generate and recycle the steam therein. In the steam press system 100, the first pump 210 is configured to draw the steam from the first piping arrangement 140. The first pump 210 is further configured to receive the rejected steam at the first pump inlet 210*a*, increase pressure of the steam, and expel the steam via the first pump outlet 210*b*, so that the pressurized steam is directed into the heat exchanger 220 via the first heat exchanger inlet port 220*a*. The second pump 230 is configured to pump fresh water at a first temperature from the freshwater source into the heat exchanger 220 via the second heat exchanger inlet port 220*b*. The first temperature may be in a range of about 5 degrees Celsius to about 35 degrees Celsius. The heat exchanger 220 is configured to condense the received pressurized steam by heating the fresh water to a second temperature greater than the first temperature. In an example, the second temperature is in a range of about 85 degrees Celsius to about 100 degrees Celsius.

The steam press system 100 may include a water level sensor 222 deposed within the heat exchanger 220. In a non-limiting example, the water level sensor 222 is an ultrasonic water level sensor, available from, for example, Water Level Control, Arizona, U.S. The water level sensor 222 is configured to detect a level of the water inside the heat exchanger 220 and generate a water level reading. Further, the heat exchanger outlet port 220*c* is configured to expel the heated water. In an example, the heated water is expelled based on the water level reading, i.e., when the water level is above a predefined water level threshold. Thereafter, the third pump 240 is configured to transfer the heated water from the heat exchanger outlet port 220*c* to the storage tank inlet 250*a*, to be stored in the storage tank 250. The storage tank 250 is configured to store the heated water at the second temperature. For this purpose, the storage tank 250 may be provided with an insulation layer. In some examples, the steam press system 100 also includes a check valve 252 located between the third pump 240 and the storage tank inlet 250*a*. The check valve 252 is configured to prevent backflow of the heated water from the storage tank 250. The fourth pump 260 is configured to pump the stored heated water from the storage tank 250 via the storage tank outlet 250*b* to the steam generator 270 via the steam generator inlet 270*a*.

The steam generator 270 is configured to receive the heated water at the second temperature from the fourth pump 260 and boil the heated water to generate steam at a third temperature. In some embodiments, the steam press system 100 may include a steam generator heating circuit 272 located within the steam generator 270. The steam generator heating circuit 272 is configured to control generation of heat within the steam generator 270, based on, for example, an amount of heated water to be converted to the steam at the third temperature. In an example, the steam generator heating circuit 272 includes at least one steam generator heating element 274, a power switch 275, and a temperature control circuit 276. The steam generator heating element 274 may be configured to generate the heat required to boil the water. In an example, the steam generator heating element 274 is a resistive heating element as known in the art ("the steam generator heating element" and "resistive heating element" are interchangeably used hereinafter). The power switch 275 may be configured to control switching ON and OFF the steam generator 270 and may be accessible from the outside of the housing by a connected button or switch. Further, the temperature control circuit 276 may be configured to control the steam generator heating element 274 to regulate steam generation with its temperature up to the third temperature. In an example, the third temperature may be in a range of 130 degrees Celsius to 180 degrees Celsius. The steam generator 270 is further configured to deliver the steam to the first steam plate inlet 110*a* and the second steam plate inlet 120*a* through the second piping arrangement 142. In some embodiments, the steam press system 100 may include a controllable pressure valve 278 connected between the steam generator outlet 270*b*, and the first steam plate inlet 110*a* and the second steam plate inlet 120*a* to ensure a regulated pressure of the steam is supplied to the first steam plate 110 and the second steam plate 120. The regulated pressure may be in the range of five bars to six bars. Further, the first steam plate 110 and the second steam plate 120 may be configured to further heat (superheat) the received steam from the third temperature to a fourth temperature greater than the third temperature. In an example, the fourth temperature may be in a range of 180 degrees Celsius to 190 degrees Celsius.

In some embodiments, the first foot pedal 130 is configured to release steam from the steam generator 270. That is, the first foot pedal 130 is configured to control the flow of steam from the steam generator 270 into the first steam plate inlet 110*a* and the second steam plate inlet 120*a*. For this purpose, as shown in FIG. 2, the first foot pedal 130 may be mechanically or electronically connected to the steam generator 270, for example, to control opening and closing of the steam generator outlet 270*b* or a valve connected to the steam generator outlet 270*b*. Further, as discussed, the first pump 210 is configured to draw the steam from the first steam plate outlet 110*b* and the second steam plate outlet 120*b*, via the first piping arrangement 140, and expel the steam at the first pump outlet 210*b*. In some embodiments, the second foot pedal 132 is configured to operate the first pump 210 to evacuate the steam from the first steam plate outlet 110*b* and the second steam plate outlet 120*b*. In particular, the second foot pedal 132 is configured to open a valve to eject the steam through the holes 114 and 124 in the first inner surface 112 and the second inner surface 122, respectively, and thereafter the first pump 210 is operated to evacuate the steam from the first steam plate outlet 110*b* and the second steam plate outlet 120*b*. For this purpose, as shown in FIG. 2, the second foot pedal 132 may be mechanically or electronically connected to the first pump 210 to regulate suction power of the first pump 210, and/or to control opening and closing of the first pump inlet 210*a* and the first pump outlet 210*b*.

Figure 3:
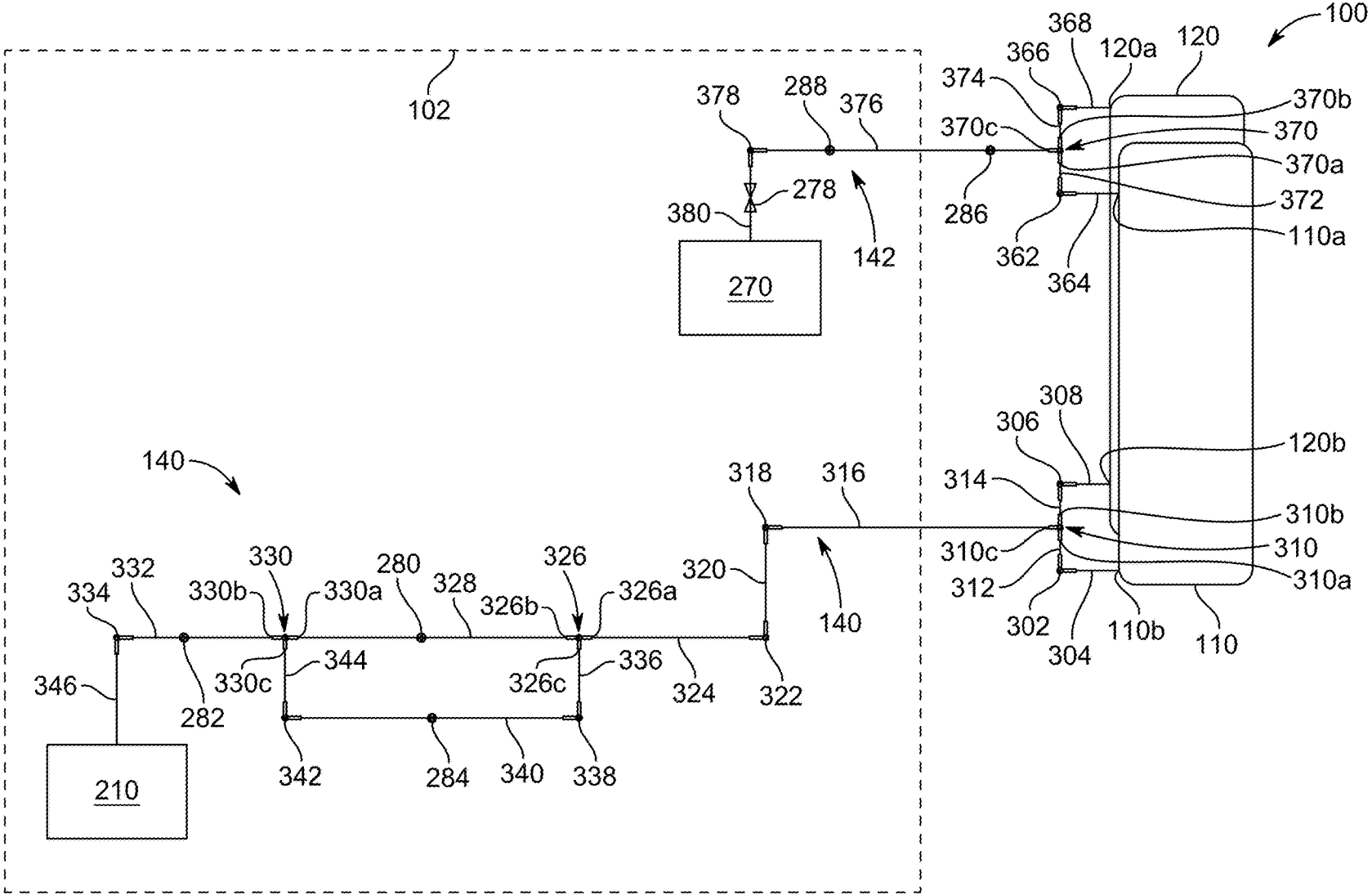
FIG. 3 is a schematic diagram of the steam press system of FIG. 1 depicting details of piping arrangements therein, according to certain embodiments.

Referring to FIG. 3, a schematic diagram of the steam press system 100 is illustrated to depict details of the first piping arrangement 140 and the second piping arrangement 142. As shown, the first piping arrangement 140 includes a first hose coupling 302. The first hose coupling 302 is configured with a flexible joint, in which the flexible joint is configured to bend at an angle in the range of zero degrees to 90 degrees. Further, the first piping arrangement 140 also includes a first flexible hose 304 connected between the first steam plate outlet 110*b* and the first hose coupling 302. The flexible connection established by the first hose coupling 302 and the first flexible hose 304 may allow movement of the first steam plate 110 with respect to the second steam plate 120 in an arcuate manner or vertical manner as described with respect to FIG. 1. Further, the first piping arrangement 140 includes a second hose coupling 306 configured with a 90 degree bend. The first piping arrangement 140 also includes a second flexible hose 308 connected between the second steam plate outlet 120*b* and the second hose coupling 306. Such connection as provided by the second hose coupling 306 and the second flexible hose 308 allows a flexible connection of the first hose coupling 302 and the first flexible hose 304 to the steam plates, to enable relative movement between the first steam plate 110 and the second steam plate 120 in the steam press system 100.

The first piping arrangement 140 further includes a third hose coupling 310 having a T shape, with a first T joint 310*a*, a second T joint 310*b* and a main joint 310*c*. A first rigid pipe 312 is connected between the first T joint 310*a* of the third hose coupling 310 and the first hose coupling 302. A second rigid pipe 314 is connected between the second T joint 310*b* of the third hose coupling 310 and the second hose coupling 306. Further, a third rigid pipe 316 is connected to the main joint 310*c* of the third hose coupling 310. The first piping arrangement 140 further includes a fourth hose coupling 318 configured with a 90 degree bend. The third rigid pipe 316 is connected to the fourth hose coupling 318. Also, a fourth rigid pipe 320 is connected to the fourth hose coupling 318. The first piping arrangement 140 further includes a fifth hose coupling 322 configured with a 90 degree bend, and the fourth rigid pipe 320 is connected to the fifth hose coupling 322. A fifth rigid pipe 324 is also connected to the fifth hose coupling 322. The first piping arrangement 140 further includes a sixth hose coupling 326 having a T shape, with a first T joint 326*a*, a second T joint 326*b* and a main joint 326*c*. The first T joint 326*a* of the sixth hose coupling 326 is connected to the fifth rigid pipe 324. A sixth rigid pipe 328 is connected to the second T joint 326*b* of the sixth hose coupling 326. The first piping arrangement 140 further includes a seventh hose coupling 330 having a T shape with a first T joint 330*a*, a second T joint 330*b* and a main joint 330*c*. The first T joint 330*a* of the seventh hose coupling 330 is connected to the sixth rigid pipe 328. A seventh rigid pipe 332 is connected to the second T joint 330*b* of the seventh hose coupling 330. The first piping arrangement 140 further includes an eighth hose coupling 334 having a 90 degree bend. The eighth hose coupling 334 is connected to the seventh rigid pipe 332. Further, an eighth rigid pipe 336 is connected to the main joint 326*c* of the sixth hose coupling 326. The first piping arrangement 140 further includes a ninth hose coupling 338 having a 90 degree bend. A ninth rigid pipe 340 is connected to the ninth hose coupling 338. The first piping arrangement 140 further includes a tenth hose coupling 342 having a 90 degree bend. The tenth hose coupling 342 is connected to the ninth rigid pipe 340. Further, a tenth rigid pipe 344 is connected to the tenth hose coupling 342 and the main joint 330*c* of the seventh hose coupling 330. Further, a third flexible hose 346 is connected between the eighth hose coupling 334 and the first pump 210. The third flexible hose 346 allows for some movement of the first pump 210 with respect to the first piping arrangement 140, in the steam press system 100.

As discussed with reference to FIG. 2, the first pump 210 draws the steam from the first piping arrangement 140 and expels the steam at the first pump outlet 210*b*. Referring to FIG. 2 and FIG. 3 in combination, the first piping arrangement 140 may include a first pressure sensor 280 coupled to the sixth rigid pipe 328. The first piping arrangement 140 may also include a second pressure sensor 282 coupled to the seventh rigid pipe 332. That is, the first pressure sensor 280 and the second pressure sensor 282 are connected between the first steam plate outlet 110*b* and the first pump 210. The first piping arrangement 140 may further include a first temperature sensor 284 coupled to the ninth rigid pipe 340. That is, the first temperature sensor 284 is connected in a bypass line between the first steam plate outlet 110*b* and the first pump 210. In some embodiments, the first pressure sensor 280 and the second pressure sensor 282 may be configured to measure and provide readings for first pressure and second pressure of the steam passing through the sixth rigid pipe 328 and the seventh rigid pipe 332, respectively. Further, the first temperature sensor 284 may be configured to measure and provide readings for the first temperature of the steam passing through the ninth rigid pipe 340. Together, the first pressure sensor 280, the second pressure sensor 282 and the first temperature sensor 284 may determine temperature and pressure readings of the rejected steam, as received from the first piping arrangement 140. The first pressure and the second pressure should be in the range of five bars to six bars.

The second piping arrangement 142 includes an eleventh hose coupling 362. The eleventh hose coupling 362 is configured with a flexible joint, in which the flexible joint is configured to bend at an angle in the range of zero degrees to 90 degrees. Further, the second piping arrangement 142 includes a fourth flexible hose 364 connected between the first steam plate inlet 110*a* and the eleventh hose coupling 362. The flexible connection established by the eleventh hose coupling 362 and the fourth flexible hose 364 allows movement of the first steam plate 110 with respect to the second steam plate 120 in the upwards and downwards directions. Further, the second piping arrangement 142 includes a twelfth hose coupling 366 configured with a 90 degree bend. The second piping arrangement 142 also includes a fifth flexible hose 368 connected between the second steam plate inlet 120*a* and the twelfth hose coupling 366. Such connection as provided by the twelfth hose coupling 366 and the fifth flexible hose 368 allows to accommodate for flexible connection provided by the eleventh hose coupling 362 and the fourth flexible hose 364, to enable relative movement between the first steam plate 110 and the second steam plate 120 in the steam press system 100.

The second piping arrangement 142 further includes a thirteenth hose coupling 370 having a T shape, with a first T joint 370*a*, a second T joint 370*b* and a main joint 370*c*. An eleventh rigid pipe 372 is connected between the first T joint 370*a* of the thirteenth hose coupling 370 and the eleventh hose coupling 362. A twelfth rigid pipe 374 is connected between the second T joint 370*b* of the thirteenth hose coupling 370 and the twelfth hose coupling 366. Further, a thirteenth rigid pipe 376 is connected to the main joint 370*c* of the thirteenth hose coupling 370. The second piping arrangement 142 further includes a fourteenth hose coupling 378 configured with a 90 degree bend. The thirteenth rigid pipe 376 is connected to the fourteenth hose coupling 378. Also, a sixth flexible hose 380 is connected between the fourteenth hose coupling 378 and the steam generator 270. The sixth flexible hose 380 allows for some movement of the steam generator 270 with respect to the second piping arrangement 142, in the steam press system 100.

As discussed with reference to FIG. 2, the steam generator 270 delivers the steam to the first steam plate inlet 110*a* and the second steam plate inlet 120*a* through the second piping arrangement 142. Referring to FIG. 2 and FIG. 3 in combination, the second piping arrangement 142 may include a third pressure sensor 286 coupled to the thirteenth rigid pipe 376. In an embodiment, the third pressure sensor 286 is located at the steam generator outlet 270*b*. The second piping arrangement 142 may also include a third temperature sensor 288 connected to the thirteenth rigid pipe 376. That is, the third temperature sensor 288 is located at the steam generator outlet 270*b*. In some embodiments, the third pressure sensor 286 may be configured to measure and provide readings for third pressure of the steam passing through the thirteenth rigid pipe 376. Further, the third temperature sensor 288 may be configured to measure and provide readings for the third temperature of the steam passing through the thirteenth rigid pipe 376. Together, the third pressure sensor 286 and the third temperature sensor 288 may determine temperature and pressure readings of the steam, to be supplied via the second piping arrangement 142. The third pressure may be within the range of five bars to six bars.

Referring back to FIG. 2, the steam press system 100 further includes a fourth pressure sensor 290 located at the second heat exchanger inlet port 220*b*. The fourth pressure sensor 290 may be configured to measure and provide readings for fourth pressure of fresh water being supplied to the heat exchanger 220. The steam press system 100 further includes a fifth pressure sensor 292 located at the heat exchanger outlet port 220*c*. The fifth pressure sensor 292 may be configured to measure and provide readings for fifth pressure of the heated water being provided by the heat exchanger 220. The fifth pressure may be within the range of five bars to six bars. The steam press system 100 further includes a second temperature sensor 294 located at the heat exchanger outlet port 220*c*. The second temperature sensor 294 may be configured to measure and provide readings for the second temperature of the heated water being provided by the heat exchanger 220. The steam press system 100 further includes a fourth temperature sensor 296 located in at least one of the first steam plate 110 and the second steam plate 120. In an example, the fourth temperature sensor 296 may include two temperature sensors located in each of the first steam plate 110 and the second steam plate 120. The fourth temperature sensor 296 may be configured to measure and provide readings for the fourth temperature of the steam in the first steam plate 110 and the second steam plate 120.

Figure 4:
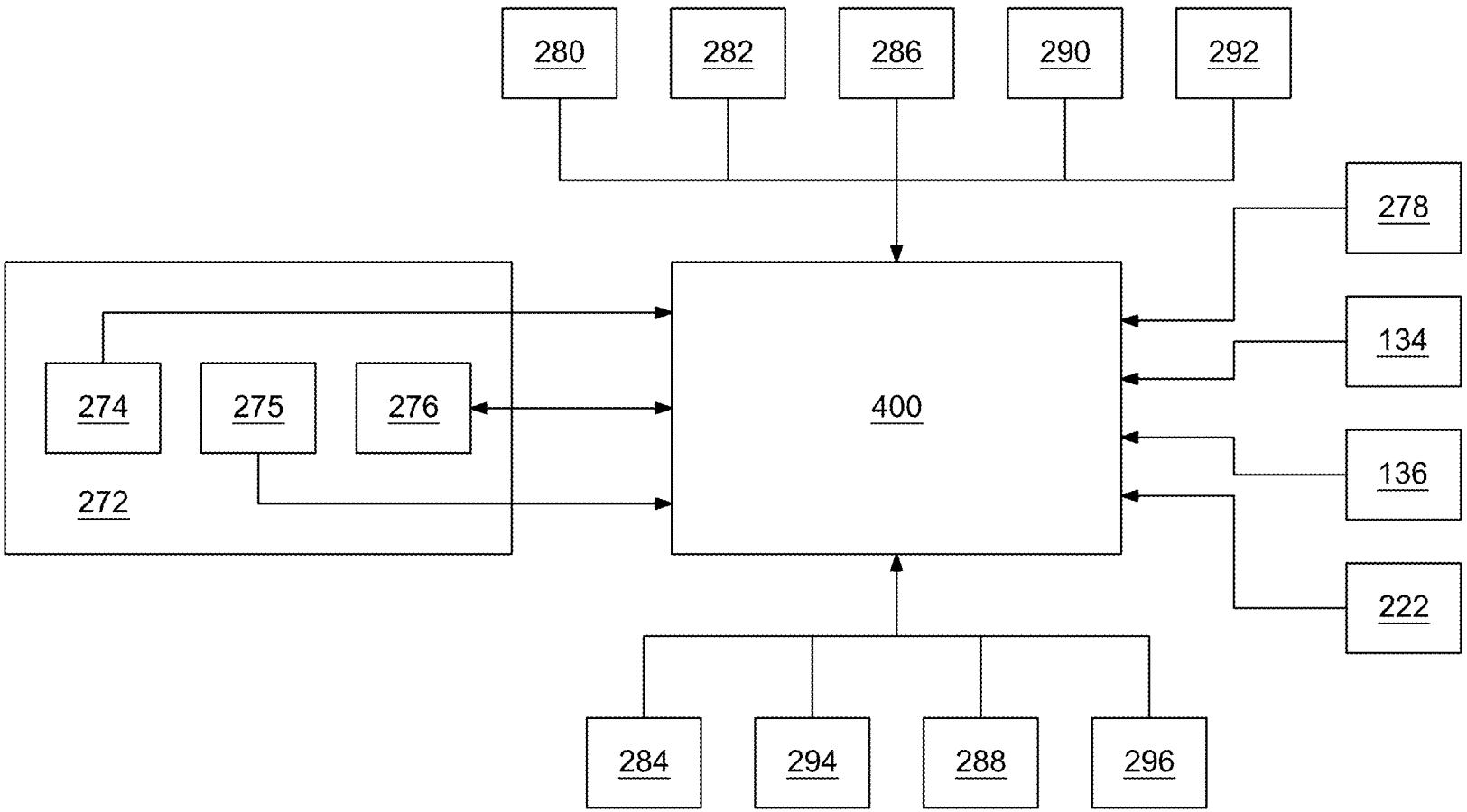
FIG. 4 is a block diagram depicting connections between a controller and various components of the steam press system, according to certain embodiments.

In some embodiments, the steam press system 100 further includes a controller 400 configured to control generation and recycling of the steam. FIG. 4 illustrates an exemplary block diagram showing connections between the controller 400 and various components of the steam press system 100. As shown, the controller 400 is connected to:

(a) the first temperature sensor 284, the second temperature sensor 294, the third temperature sensor 288, the fourth temperature sensor 296 to receive respective readings for the first, second, third, and fourth temperatures;

(b) the first pressure sensor 280, the second pressure sensor 282, the third pressure sensor 286, the fourth pressure sensor 290, the fifth pressure sensor 292 to receive respective readings of the first, second, third, fourth and fifth pressures, wherein the first, second, third, fourth and fifth pressures are within the range of five bars to six bars;

(c) the controllable pressure valve 278 to regulate flow of the steam by controlling the pressure of the steam (i.e., the third pressure) being supplied to the first steam plate 110 and the second steam plate 120; and (d) the steam generator heating circuit 272 to control steam generation.

In the steam generator heating circuit 272, the controller 400 is connected to: (a) the steam generator heating element 274 to regulate supply of power thereto thereby controlling the temperature and pressure within the steam generator 270, and (b) the power switch 275 and the temperature control circuit 276 to control heating of the water in the steam generator 270 and thus generation of the steam. The controller 400 may further be connected to the water level sensor 222 to receive the corresponding water level reading therefrom. The controller 400 is configured to adjust a power supplied to the first pump 210 based on the water level reading to supply a sufficient amount of the rejected heat to bring the temperature of water in the heat exchanger 220 to the required second temperature. In some embodiments, the controller 400 may also be provided with a first set of temperature setpoint values which may define standard operational values for the first, second, third, and fourth temperatures, and a second set of pressure setpoint values which may define standard operational values for the first, second, third, fourth and fifth pressures. The said first set of temperature setpoint values and the second set of pressure setpoint values may be stored in a memory (such as a memory 1102 in FIG. 11) associated with the controller 400. Further, the controller 400 is connected to the temperature control switch 134 and the pressure control switch 136. The temperature control switch 134 and the pressure control switch 136 may be operated to provide instructions to change the first set of temperature setpoint values and the second set of pressure setpoint values, respectively, stored in the controller 400, for example, for particular ironing operation based on the requirement.

In some embodiments, the controller 400 includes a non-transitory computer readable medium having instructions stored therein that, when executed by one or more processors, cause the one or more processors to perform corresponding functions. In some embodiments, the controller 400 may be implemented in hardware, firmware or software, or some combination of at least two of the same. It should be noted that the functionality associated with the controller 400 may be centralized or distributed, whether locally or remotely. The controller 400 may be a multi-core processor, a single core processor, or a combination of one or more multi-core processors and one or more single core processors. For example, the one or more processors may be embodied as one or more of various processing devices, such as a coprocessor, a microprocessor, a digital signal processor (DSP), a processing circuitry with or without an accompanying DSP, or various other processing devices including integrated circuits such as, for example, an application specific integrated circuit (ASIC), a field programmable gate array (FPGA), a microcontroller unit (MCU), a hardware accelerator, a special-purpose computer chip, or the like. Further, the memory associated with the controller 400 may include one or more non-transitory computer-readable storage media that can be read or accessed by other components in the device. The memory may be any computer-readable storage media, including volatile and/or non-volatile storage components, such as optical, magnetic, organic, or other memory or disc storage, which can be integrated in whole or in part with the device. In some examples, the memory may be implemented using a single physical device (e.g., optical, magnetic, organic, or other memory or disc storage unit), while in other embodiments, the memory may be implemented using two or more physical devices without any limitations.

In some embodiments, the controller 400 is configured to monitor the first, second, third, and fourth temperatures. The controller 400 is further configured to monitor the first, second, third, fourth and fifth pressures. The controller 400 is also configured to compare the first, second, third, and fourth temperatures to the first set of temperature setpoint values. The controller 400 is further configured to compare the first, second, third, fourth and fifth pressures to the second set of pressure setpoint values. As such, the controller 400 may be configured to generate control signals to adjust the first pump 210, the second pump 230, the third pump 240, the fourth pump 260, the controllable pressure valve 278, and a power supplied to the steam generator heating circuit 272 to the first set of temperature setpoint values and the second set of pressure setpoint values. In particular, the controller 400 is configured to generate control signals to adjust the first pump 210, the second pump 230, the third pump 240, the fourth pump 260, the controllable pressure valve 278, and the power supplied to the steam generator heating circuit 272 to cause the first, second, third, and fourth temperatures to match the first set of temperature setpoint values and the first, second, third, fourth and fifth pressures to match the second set of pressure setpoint values. That is, the controller 400 may control the components to regulate the first, second, third, and fourth temperatures, and the first, second, third, fourth and fifth pressures based on the corresponding setpoint values as preset by the user. For instance, if the user wishes to use steam with high temperature and high pressure to iron heavy clothes, then the user may use the temperature control switch 134 to increase the setpoint value for the third temperature (i.e., the temperature at which the steam is supplied to the first steam plate 110 and the second steam plate 120) and the pressure control switch 136 to increase the setpoint value for the third pressure (i.e., the pressure at which the steam is supplied to the first steam plate 110 and the second steam plate 120). It may be appreciated that the setpoint values for other temperatures and pressures may automatically be adjusted based on adjustment of, for example, the third temperature and/or the third pressure based on operating parameters of the steam press system 100. As would be contemplated by a person skilled in the art, the controller 400 may utilize predefined or preprogrammed value maps for this purpose, not described herein for brevity of the present disclosure.

Figure 5:
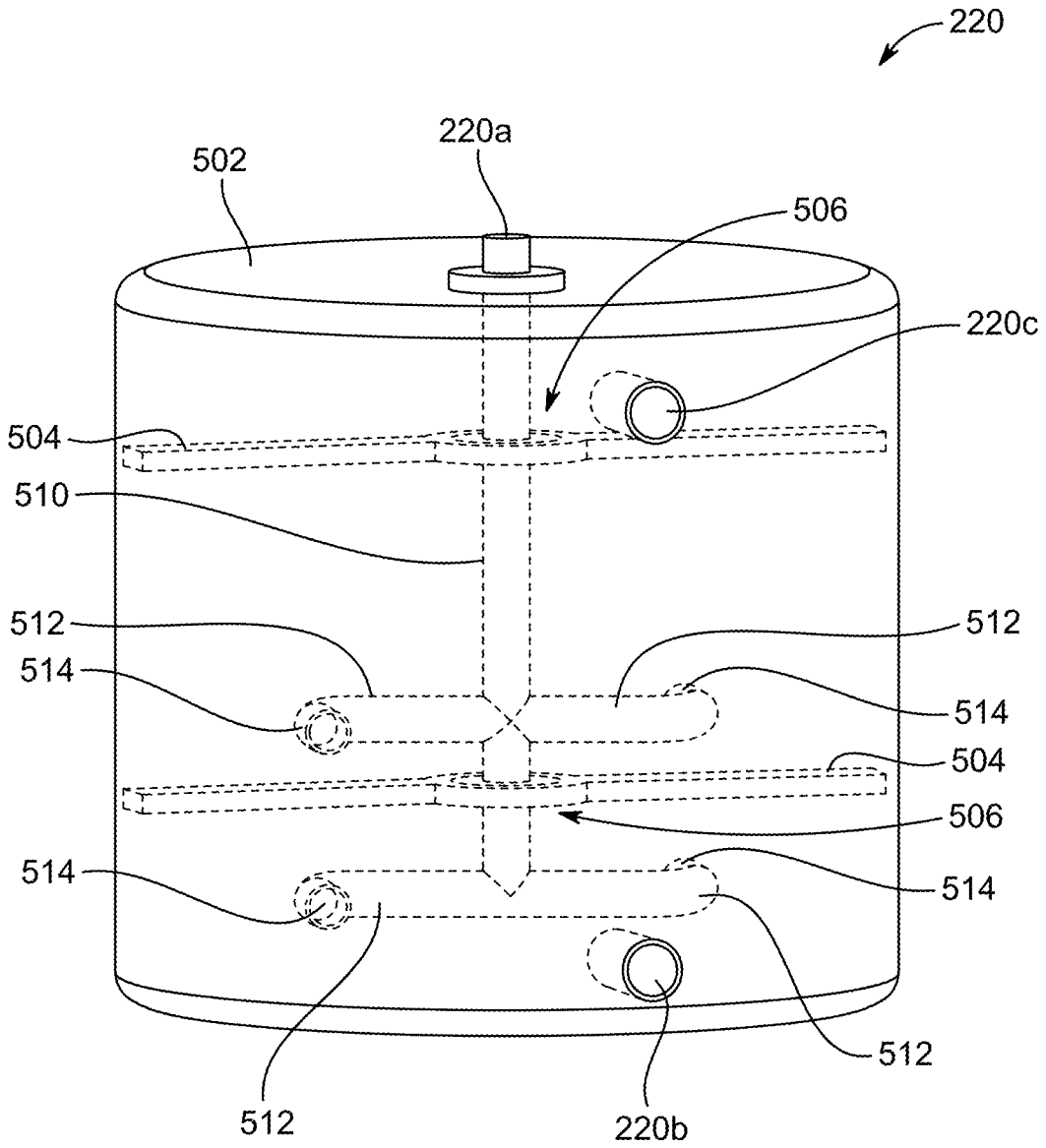
FIG. 5 illustrates of a rotating arm based heat exchanger of the steam press system, according to one embodiment.
Figure 6A:
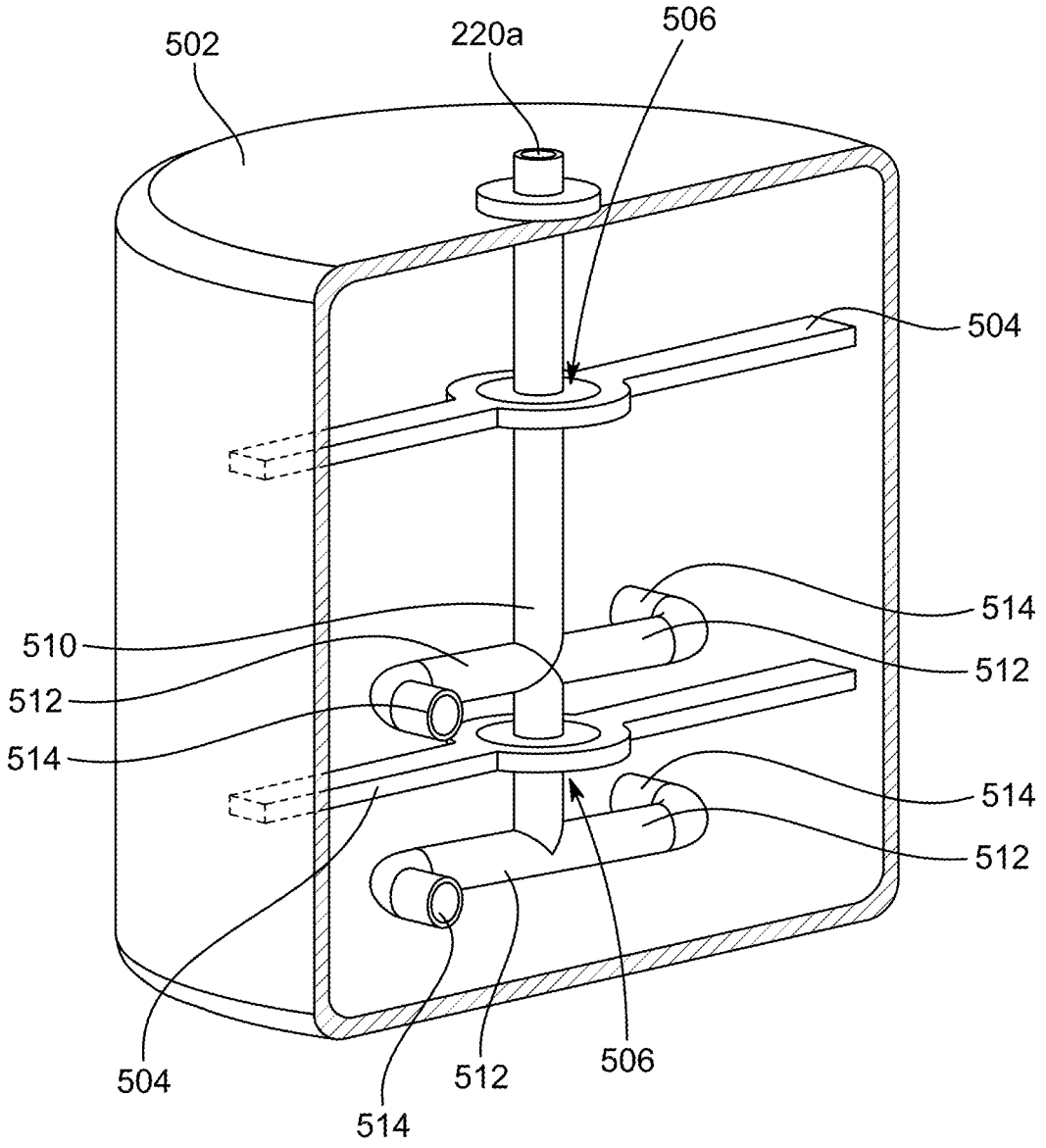
FIG. 6A is a cross-sectional view of the rotating arm based heat exchanger of FIG. 5, according to certain embodiments.

Referring to FIG. 5, a perspective view of the heat exchanger 220 is illustrated. Further referring to FIG. 6A, a cross-sectional view of the heat exchanger 220 of FIG. 5 is illustrated. As shown in FIG. 5 and FIG. 6A, the heat exchanger 220 includes a housing 502 embodied as a cylindrical insulated structure. That is, the housing 502 may include an insulation layer (not shown) thereon. The insulation layer may prevent loss of heat from the interior of the housing 502 where the rejected steam at high temperature is received to mix with fresh water to generate heated water. As seen in FIG. 5, the housing 502 provides the first heat exchanger inlet port 220*a*, the second heat exchanger inlet port 220*b* and the heat exchanger outlet port 220*c*.

Figure 6B:
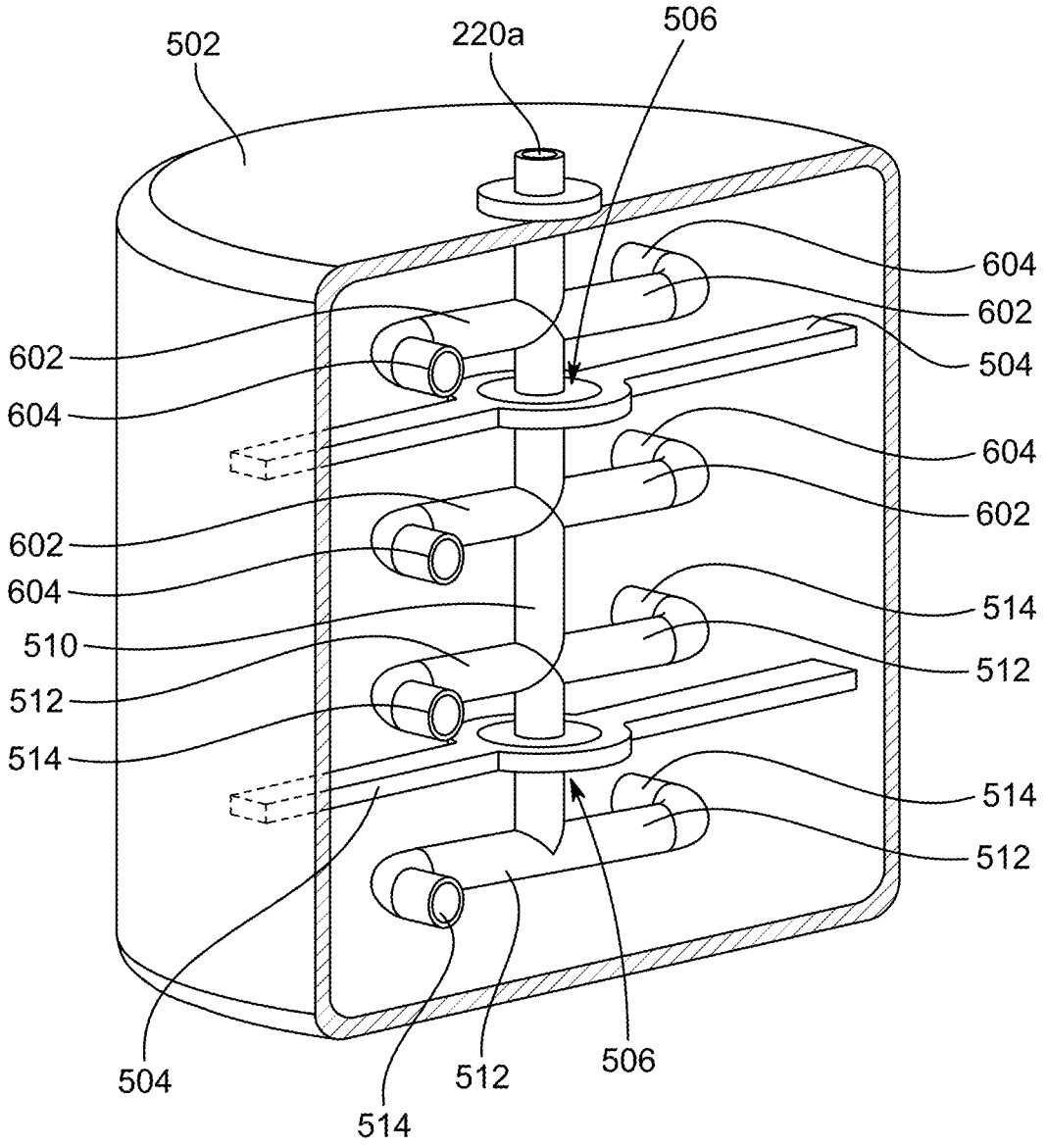
FIG. 6B is a cross-sectional view of the rotating arm based heat exchanger of FIG. 5 with additional pipe arms, according to certain embodiments.

In some embodiments, the heat exchanger 220 is a direct contact heat exchanger to achieve rapid condensation and maximum heat transfer. The heat exchanger 220 includes a plurality of supports 504, ends of which are attached to interior of the housing 502. Each support 504 has a circular opening 506 (see FIG. 6A) at a central location. In an example, each circular opening 506 includes a rotatable bearing (not shown). Further, as shown, the heat exchanger 220 includes a swirl generator 510 inserted through the first heat exchanger inlet port 220*a* and through the rotatable bearings. In the heat exchanger 220, the swirl generator 510 is connected to the first pump outlet 210*b*. The swirl generator 510 is in the form of a pipe and is configured to extend coaxially with a central axis of the cylindrical insulated housing 502. Furthermore, as shown, the heat exchanger 220 includes a plurality of pipe arms 512 located on the swirl generator 510. In the example illustration of FIGS. 5 and 6A, four pipe arms 512 are shown, arranged in two pairs disposed in two planes towards bottom of the housing 502. Each pipe arm 512 ends in a 90 degree bend (as represented by reference numeral 514). Although the bends 514 are disposed at 90 degrees and in same plane with respect to the corresponding pipe arm 512, in other embodiments, the bends 514 may be disposed at angles other than 90 degrees and in a different plane with respect to the corresponding pipe arm 512. In the heat exchanger 220, each pipe arm 512 is configured receive steam from the swirl generator 510 and expel steam into the freshwater present in the housing 502 through the respective bend 514. The bends 514 act as nozzles to expel steam into the fresh water at high pressure. This expelling of the steam from oppositely directed bends 514 may generate opposing force, which rotates each pipe arm 512 around the central axis (due to support of the swirl generator 510 by the rotatable bearings), such that a swirling flow is generated in the freshwater to cause proper mixing of the steam into the fresh water and thus faster heating of water in the heat exchanger 220. In some embodiments, a size (area) of opening of the bends (nozzles) 514 may be varied to regulate pressure at which the steam is expelled into the fresh water, and thereby control swirling flow generated in the heat exchanger 220. Referring to FIG. 6B, a cross-sectional view of the heat exchanger 220 is illustrated according to another embodiment. The swirl generator 510 may include additional pipe arms 602, specifically two additional pipe arms 602 with corresponding bends 604. In an embodiment, the pipe arms 602 and the pipe arms 512 may be located equidistant from an adjacent pipe arm along the swirl generator 510. Such additional pipe arms 602 may help with uniform expelling of the steam inside the housing 502 of the heat exchanger 220 and may further increase degree of swirl in the freshwater, thereby resulting in even mixing of the steam with the freshwater. Thus, faster heating of water in the heat exchanger 220 may be achieved as compared to the embodiment illustrated in FIG. 6A.

Figure 6C:
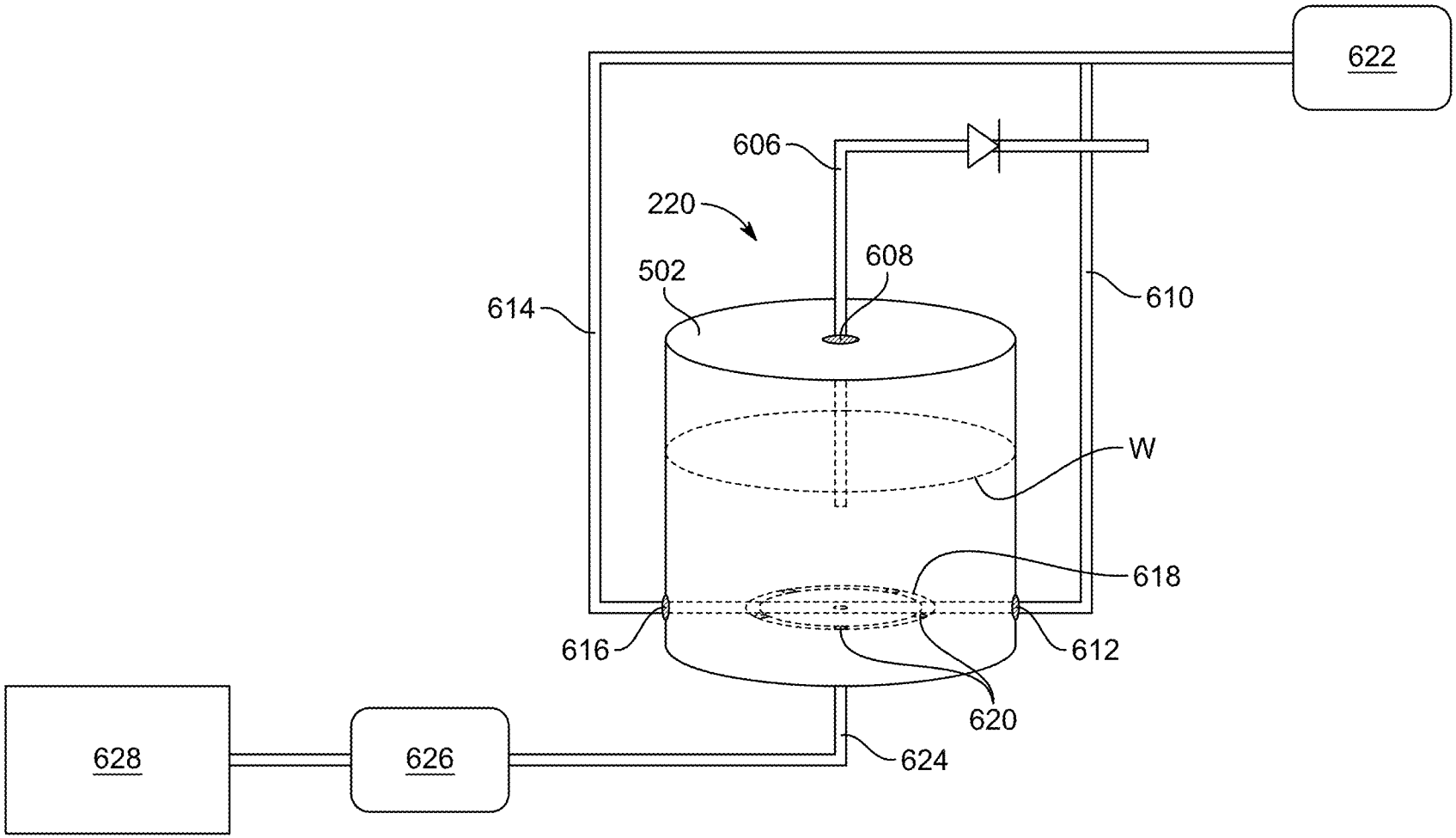
FIG. 6C illustrates a ring based heat exchanger, according to certain embodiments.

FIG. 6C illustrates an alternative embodiment of the heat exchanger 220. In FIG. 6C, a ring 618 is employed to mix the recycled steam 622 generated by the steam press of the previous embodiments. A manifold having a first pipe branch 614 and a second pipe branch 610 splits the recycled steam 622 into two streams. The steam from first pipe branch 614 enters the housing through a first steam port 616 and the steam from the second pipe branch 610 enters the housing through a second steam port 612. Each steam port includes a seal to prevent water loss from the housing 502. The first pipe branch 614 and the second pipe branch 610 are fluidly connected to each other and to a ring 618, which has steam holes 620. Additionally, a steam hole 620 (see FIG. 6D) is located in the pipe at the center of the ring 618. A water pipe 606 having an end in the water, W, inside the housing, draws the heated water (through action of a pump, not shown) out of the housing, where it is delivered to the steam generator 270. Alternatively, the heated water may be delivered to the storage tank 250. The pump may be essentially the same as the pump 240 or the pump 260 shown in FIG. 2. The heated water pipe 606 exits the housing 502 through a sealed exit port 608. The heat exchanger 220 is supplied with fresh water 628, which is pumped by fresh water pump 626 through fresh water pipe 624 into the bottom of the housing 220. In operation, steam from the steam manifold is propelled into the water at the bottom of the housing through the steam holes. The pressure of the steam entering the water in the housing 502 may be within the range of five bars to six bars, and the temperature of the fresh water may initially be in the range of about 5 degrees Celsius to about 35 degrees Celsius. The heat from the steam heats the fresh water to a second temperature in a range of about 85 degrees Celsius to about 100 degrees Celsius.

Figure 6D:
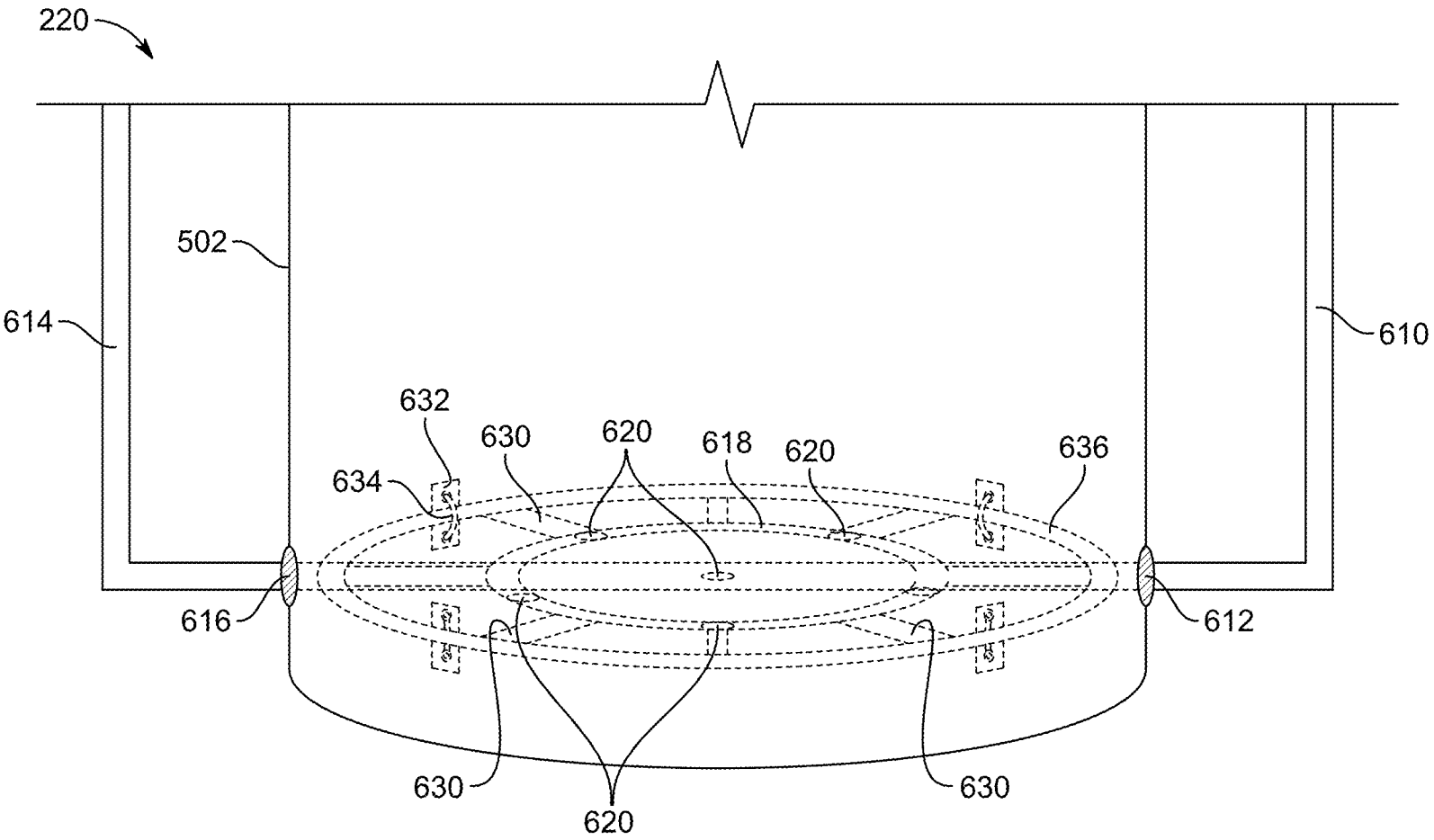
FIG. 6D illustrates ring support arms of the ring based heat exchanger of FIG. 6C according to certain embodiments.

FIG. 6D illustrates a manner in which the ring 618 may be supported within the housing 502. An outer ring 638 may be connected to the inner wall of the housing by mounts 632 and held in place by collars 634. Spokes 630 radiating from the outer ring 638 are connected to the ring 618 by clamps (not shown). The steam holes 620 are shown in the ring 618 and in the center of the steam manifold. The collars 634 may be rubber or rubberized metal to prevent vibration noise. The mounts 632 may hold the ring 618 at a height in the range of 2 cm to 10 cm above the bottom of the housing 520.

Figure 6E:
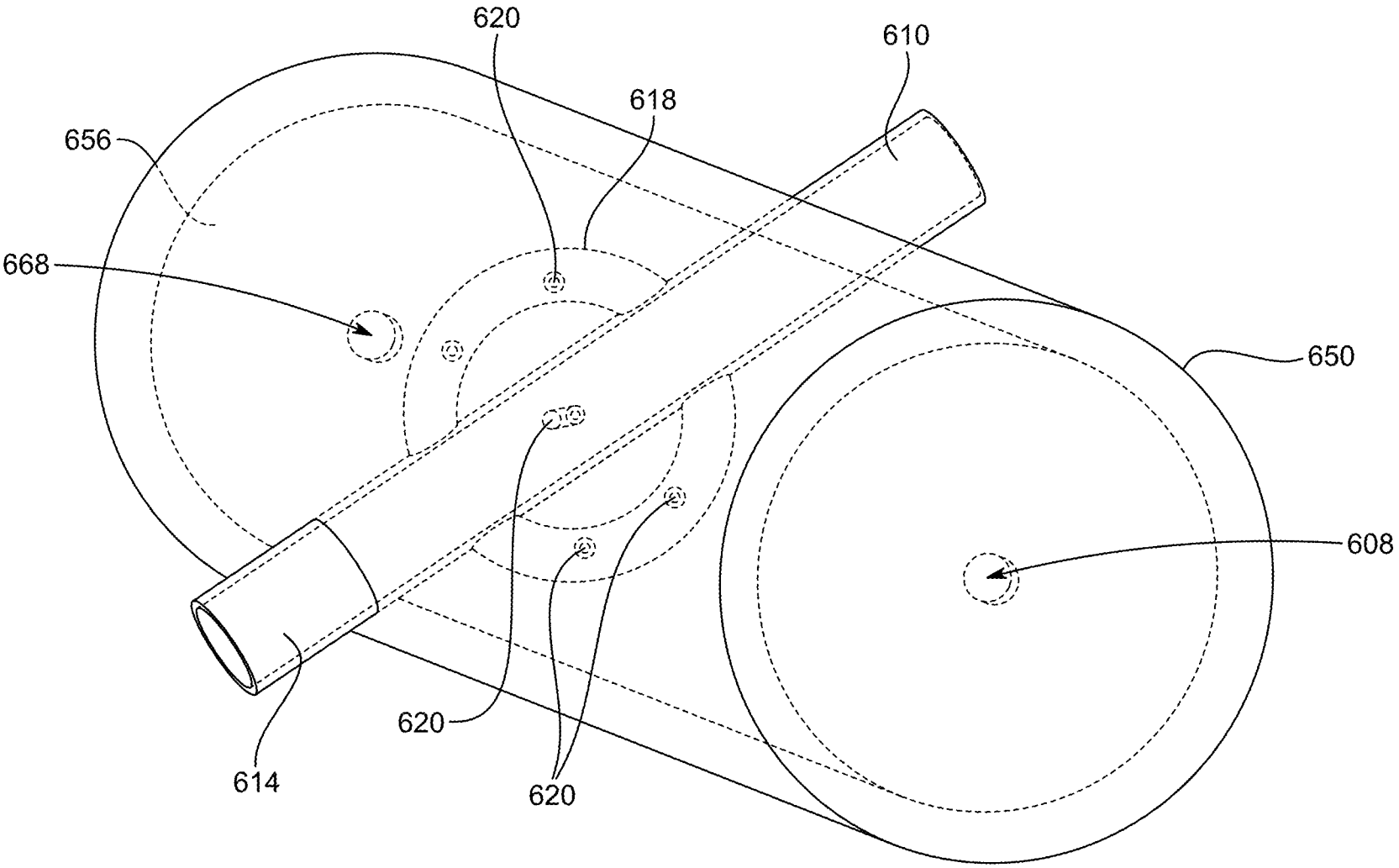
FIG. 6E illustrates details of a side view of the ring based heat exchanger of FIG. 6D, according to certain embodiments.

FIG. 6E shows a side view of the heat exchanger of FIG. 6C, in which a fresh water inlet port 668 at the bottom 656 of housing 502 is shown more clearly. The steam holes 620 in the ring and in the center of the steam pipe are shown. The sealed exit port 608 is shown at the top 650 of the heat exchanger.

Figure 6F:
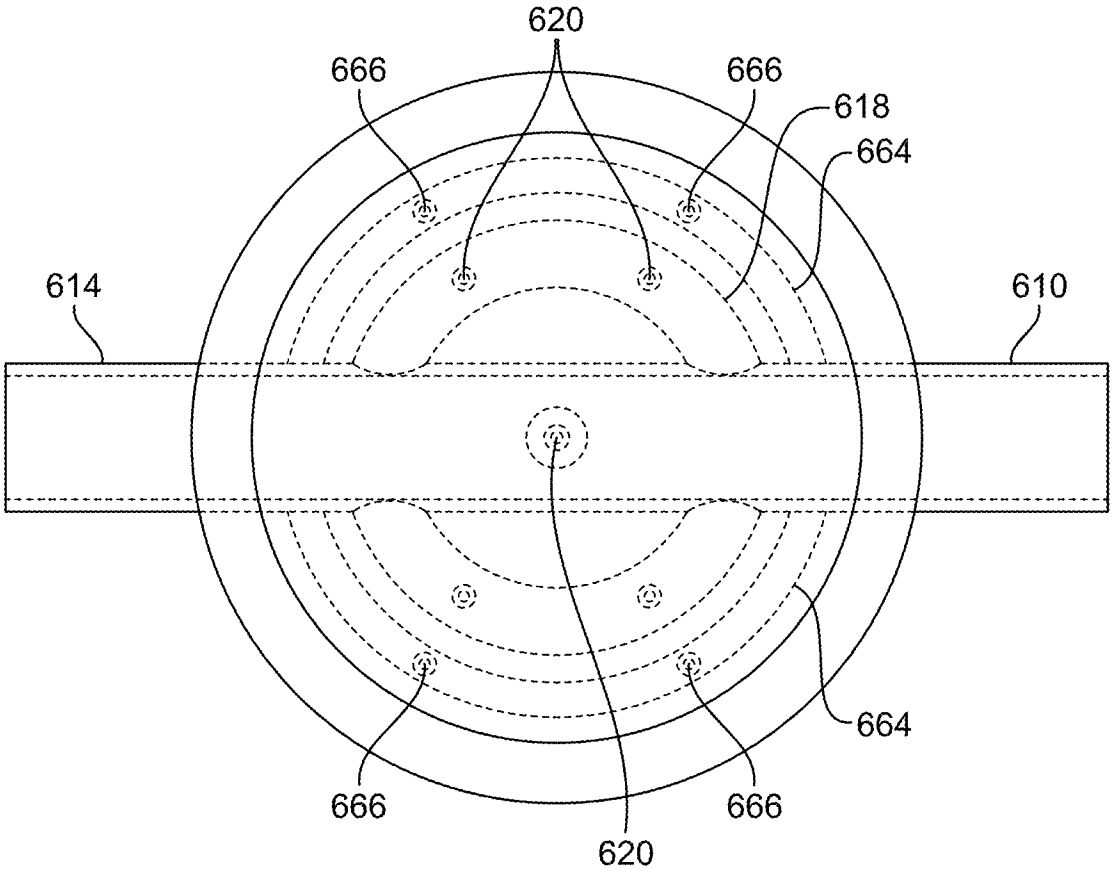
FIG. 6F illustrates a ring based heat exchanger having two rings, according to certain embodiments.

FIG. 6F illustrates another embodiment of the heat exchanger 220 having two steam rings. The embodiment of FIG. 6F is essentially the same as the embodiment of FIG. 6C, but with the addition of a second steam ring. A top cross-section is shown in which ring 618 is an inner ring and ring 664 is an outer ring. Ring 618 has steam holes 620 and ring 664 has steam holes 666. The manifold labelled as first pipe branch 614 and second pipe branch 610 also has a steam hole 620. The manifold is fluidly connected to the ring 618 and the ring 664. The ring 618 and the ring 664 are concentric and at the same height from the bottom of the housing, which height may be in the range of 2 cm to 10 cm above the bottom of the housing 520.

In FIG. 6C-FIG. 6F, the steam holes 620 and 666 may be 2 mm to 6 mm in diameter. In a particular embodiment of the ring 618 of FIG. 6C, the steam holes 620 may be 4 mm in diameter. In a particular embodiment of the ring 618 of FIG. 6C, the steam holes 620 may be 2 mm in diameter. In another particular embodiment of FIG. 6F, the ring 618 may have steam holes of 2 mm in diameter and the ring 624 may have steam holes 666 may have a diameter of 4 mm. In another embodiment of FIG. 6F, the ring 618 may have steam holes of 4 mm in diameter and the ring 624 may have steam holes 666 may have a diameter of 2 mm. In another embodiment of FIG. 6F, the ring 618 may have steam holes of 4 mm in diameter and the ring 624 may have steam holes 666 may have a diameter of 4 mm. In another embodiment of FIG. 6F, the ring 618 may have steam holes of 6 mm in diameter and the ring 624 may have steam holes 666 may have a diameter of 4 mm. In another embodiment of FIG. 6F, the ring 618 may have steam holes of 4 mm in diameter and the ring 624 may have steam holes 666 may have a diameter of 6 mm. In another embodiment of FIG. 6F, the diameters of the steam holes 620 and 666 may be the same. In another embodiment of FIG. 6F, the diameters of the steam holes 620 and 666 may be different, in the range of 2 mm to 6 mm.

In an embodiment, the height of the heat exchanger 200 is 100 cm. However, the height of the heat exchanger 220 is not limiting and may be greater or less than 100 cm, depending on the needs of specific applications.

Any of the embodiments shown in FIG. 6C, and FIG. 6E-FIG. 6F may include the support structure shown in FIG. 6D.

Figure 7:
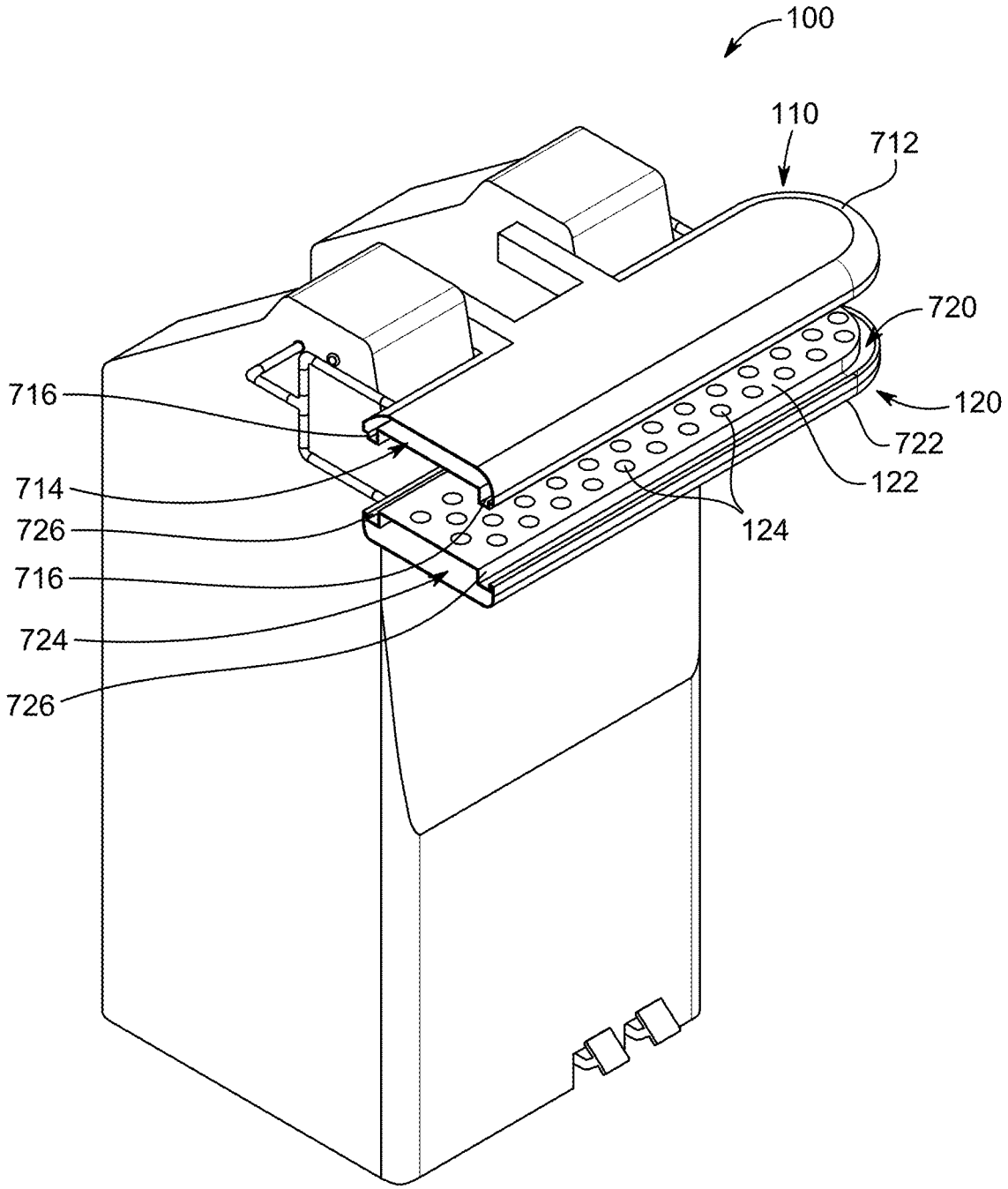
FIG. 7 shows sectioned steam plates of the steam press system, according to certain embodiments.

FIG. 7 illustrates sectioned steam plates of the steam press system of the steam press system 100. FIGS. 8A-8B illustrate cross-sectional views of steam plates 110, 120 of the steam press system 100 according to two different embodiments. Together referring to FIG. 7, FIG. 8A and FIG. 8B, as illustrated, the first steam plate 110 includes a first steam plate housing 710 having the first inner surface 112, a top cover 712, and a first middle region 714. The first middle region 714 is defined between the first inner surface 112 and the top cover 712. The top cover 712 includes extensions 716 around its circumference which protrude past the first inner surface 112. Further, the second steam plate 120 includes a second steam plate housing 720 having the second inner surface 122, a bottom cover 722 and a second middle region 724. The second middle region 724 is defined between the second inner surface 122 and the bottom cover 722. Also, the second inner surface 122 has a groove 726 around its circumference. The groove 726 is configured to receive the extensions 716 of the first steam plate housing 710 when the first steam plate 110 is pressed against the second steam plate 120, thereby achieving a leak-proof engagement of the first steam plate 110 with the second steam plate 120 in the steam press system 100. The outer surfaces of the steam plates may include insulation to prevent burns and may have handles or other hardware to allow the user to raise and lower the upper steam plate without being burned.

In one embodiment, as illustrated in FIG. 8A, the steam press system 100 may include an electromagnetic coil 810 located within the first middle region 714. Also, an alternating current circuit 812 (schematically shown) is coupled to the electromagnetic coil 810, such that the electromagnetic coil 810 generates an alternating magnetic induction field when the alternating current is applied by the alternating current circuit 812. Further, the steam press system 100 may include a permanent magnet 814 located within the second middle region 724. Eddy currents are generated in the permanent magnet 814 due to the alternating magnetic induction field. The eddy currents heat the steam in both the first steam plate 110 and the second steam plate 120 from the third temperature to the fourth temperature greater than the third temperature. That is, the steam press system 100 may provide an additional heating arrangement incorporated in the first steam plate 110 and the second steam plate 120, implementing the electromagnetic coil 810, the alternating current circuit 812 and the permanent magnet 814 to further heat (superheat) the steam to the fourth temperature, if required.

In another embodiment, as illustrated in FIG. 8B, the steam press system 100 may include a first resistive heater 820 located within the first middle region 714 and a first resistive heating circuit 822 (schematically shown) connected to the first resistive heater 820. The first resistive heating circuit 822 is configured to increase the third temperature of the steam to a temperature setpoint value. Further, the steam press system 100 may include a second resistive heater 824 located within the second middle region 724 and a second resistive heating circuit 826 (schematically shown) connected to the second resistive heater 824. The second resistive heating circuit 826 is configured to increase the third temperature of the steam to the temperature setpoint value. Herein, the temperature setpoint value may be equal to the fourth temperature which is greater than the third temperature. That is, the steam press system 100 may provide an alternative additional heating arrangement incorporated in the first steam plate 110 and the second steam plate 120, implementing the first resistive heater 820 and the corresponding first resistive heating circuit 822, and the second resistive heater 824 and the corresponding second resistive heating circuit 826, to further heat (superheat) the steam to the fourth temperature, if required.

Figure 9:
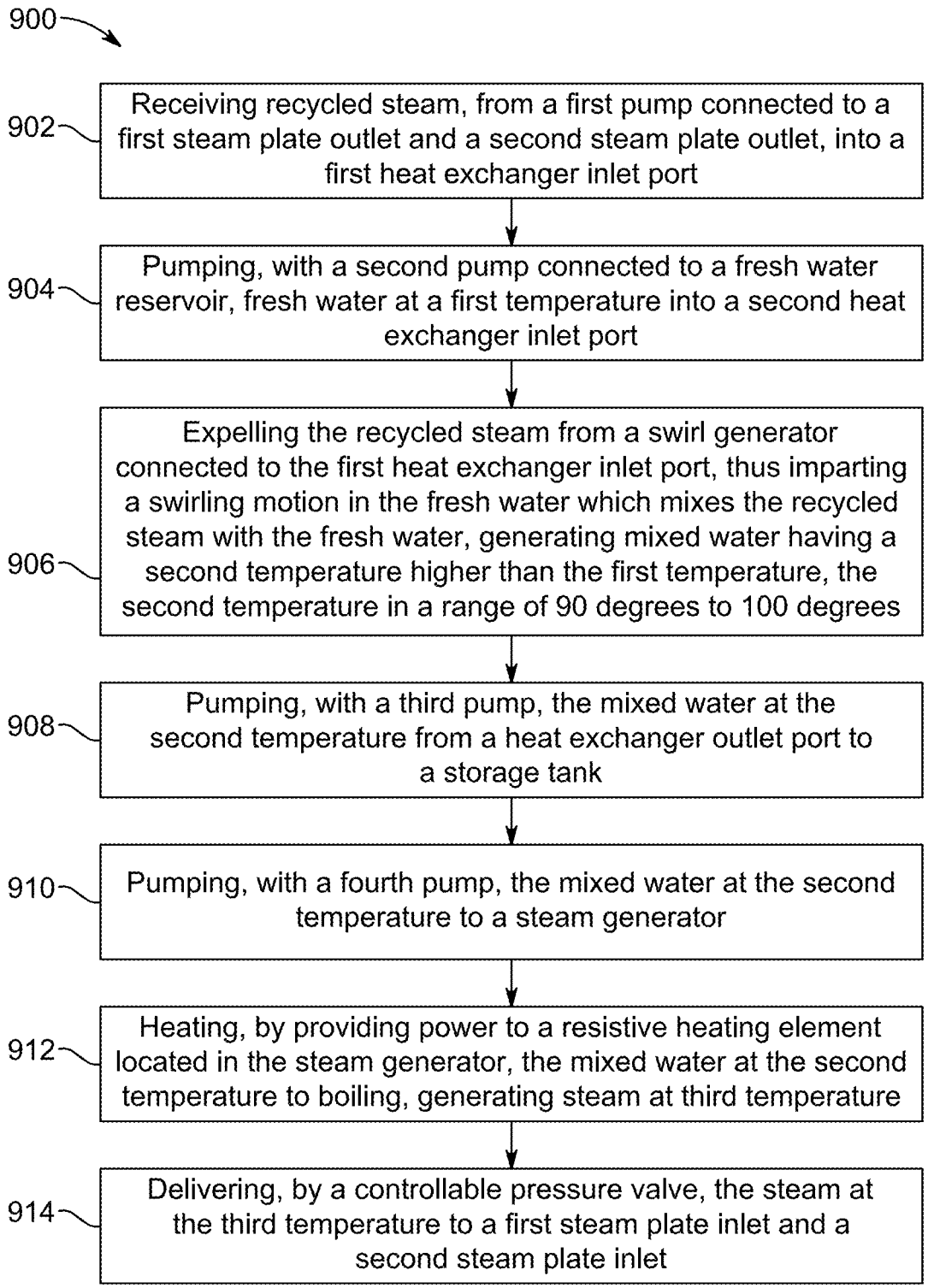
FIG. 9 is a flowchart of a method of recycling steam in a steam press, according to certain embodiments.

FIG. 9 illustrates a flowchart of a method 900 of recycling steam in the steam press system 100. Further, it may be appreciated that the steps described in reference to the method 900 are only illustrative, and other alternatives may also be provided where one or more steps are re-ordered, one or more steps are added, or one or more steps are removed without departing from the spirit and the scope of the present disclosure. The steps of the method 900 are described with reference to FIG. 1 through FIG. 8B.

At step 902, the method 900 includes receiving recycled steam, from the first pump 210 connected to the first steam plate outlet 110*b* and the second steam plate outlet 120*b*, into the first heat exchanger inlet port 220*a*. That is, in the steam press system 100, the first pump 210 draws the steam from the first steam plate 110 (through the corresponding first steam plate outlet 110*b*) and the second steam plate 120 (through the corresponding second steam plate outlet 120*b*) via the first piping arrangement 140. The first pump 210 receives the rejected steam at the first pump inlet 210*a*, increases pressure of the steam and expels the pressurized steam at the first pump outlet 210*b*. The pressurized steam is directed to the heat exchanger 220 via the first heat exchanger inlet port 220*a*.

At step 904, the method 900 includes pumping, with the second pump 230 connected to the freshwater source, fresh water at a first temperature into the second heat exchanger inlet port 220*b*. That is, the second pump 230 pumps the fresh water at the first temperature from the freshwater source into the heat exchanger 220 via the second heat exchanger inlet port 220*b*. In some embodiments, the water level sensor 222 located inside the heat exchanger 220 may be used to detect the level of the water inside the heat exchanger 220, and the second pump 230 pumps the fresh water inside the heat exchanger 220 based on the detected level of the water inside the heat exchanger 220.

At step 906, the method 900 includes expelling the recycled steam from the swirl generator 510 connected to the first heat exchanger inlet port 220*a*, thus imparting the swirling flow in the fresh water which mixes the recycled steam with the fresh water, generating mixed water having the second temperature higher than the first temperature. In the heat exchanger 220, each pipe arm 512 receives steam from the swirl generator 510 (as received from its connection with the first pump outlet 210*b*) and expels steam into the freshwater present in the housing 502 from the respective bend 514. The expelling of the steam may generate opposing force, which rotates each pipe arm 512 around the central axis (due to the rotatable bearings), such that the swirling flow is generated in the freshwater to cause enhanced mixing of the steam into the freshwater.

At step 908, the method 900 includes pumping, with the third pump 240, the mixed water at the second temperature from the heat exchanger outlet port 220*c* to the storage tank 250. That is, the third pump 240 transfers the heated water from the heat exchanger 220 through the heat exchanger outlet port 220*c* to the storage tank inlet 250*a*, to be stored in the storage tank 250. The storage tank 250 stores the heated water at the second temperature. Further, the check valve 252 may prevent backflow of the heated water from the storage tank 250.

At step 910, the method 900 includes pumping, with the fourth pump 260, the mixed water at the second temperature to the steam generator 270. That is, the fourth pump 260 transfers the stored heated water from the storage tank 250 through the storage tank outlet 250*b*, to the steam generator 270 via the steam generator inlet 270*a*.

At step 912, the method 900 includes heating, by providing power to the resistive heating element 274 located in the steam generator 270, the mixed water at the second temperature to boiling, generating steam at the third temperature. The resistive heating element 274 may be the part of the steam generator heating circuit 272 to control heat being supplied in the steam generator 270, as required to boil the heated water to generate the steam at the third temperature. The power switch 275 may be used to control switching ON and OFF the steam generator 270. Further, the temperature control circuit 276 may be used to regulate the resistive heating element 274 to heat the water generating steam with up to the defined third temperature.

At step 914, the method 900 includes delivering, by the controllable pressure valve 278, the steam at the third temperature to the first steam plate inlet 110*a* and a second steam plate inlet 120*a*. That is, the controllable pressure valve 278 is used to regulate flow of the steam by controlling the pressure of the steam (from the third pressure) being supplied to the first steam plate 110 (through the corresponding first steam plate 110) and the second steam plate 120 (through the corresponding second steam plate inlet 120*a*).

Although not illustrated through steps in FIG. 9, the method 900 further includes pressing the first foot pedal 130 to actuate the controllable pressure valve 278 to deliver steam to the first steam plate inlet 110*a* and the second steam plate inlet 120*a*. The method 900 further includes heating, by resistive heating or inductive heating (as described in reference to FIGS. 8A and 8B), the steam within the first steam plate 110 and the second steam plate 120 to the fourth temperature higher than the third temperature. The method 900 further includes pressing the second foot pedal 132 to actuate the first pump 210 to evacuate the steam from the first steam plate outlet 110*b* and the second steam plate outlet 120*b*. The method 900 further includes pumping, by the first pump 210, the steam into the first heat exchanger inlet port 220*a* to recycle the steam.

Figure 10:
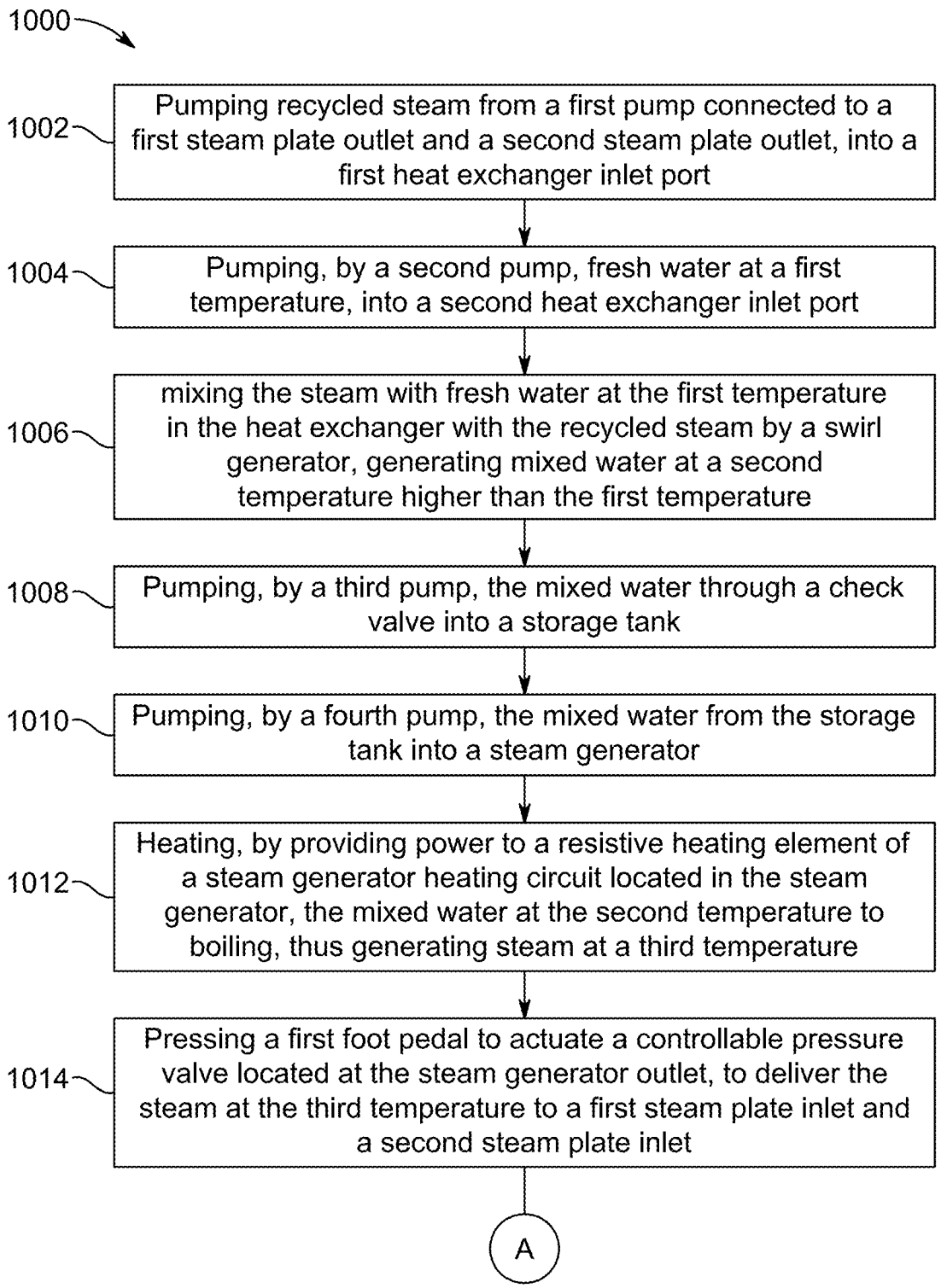
FIG. 10 is a flowchart of a method of controlling steam generation in a steam press, according to certain embodiments.
Figure 10:
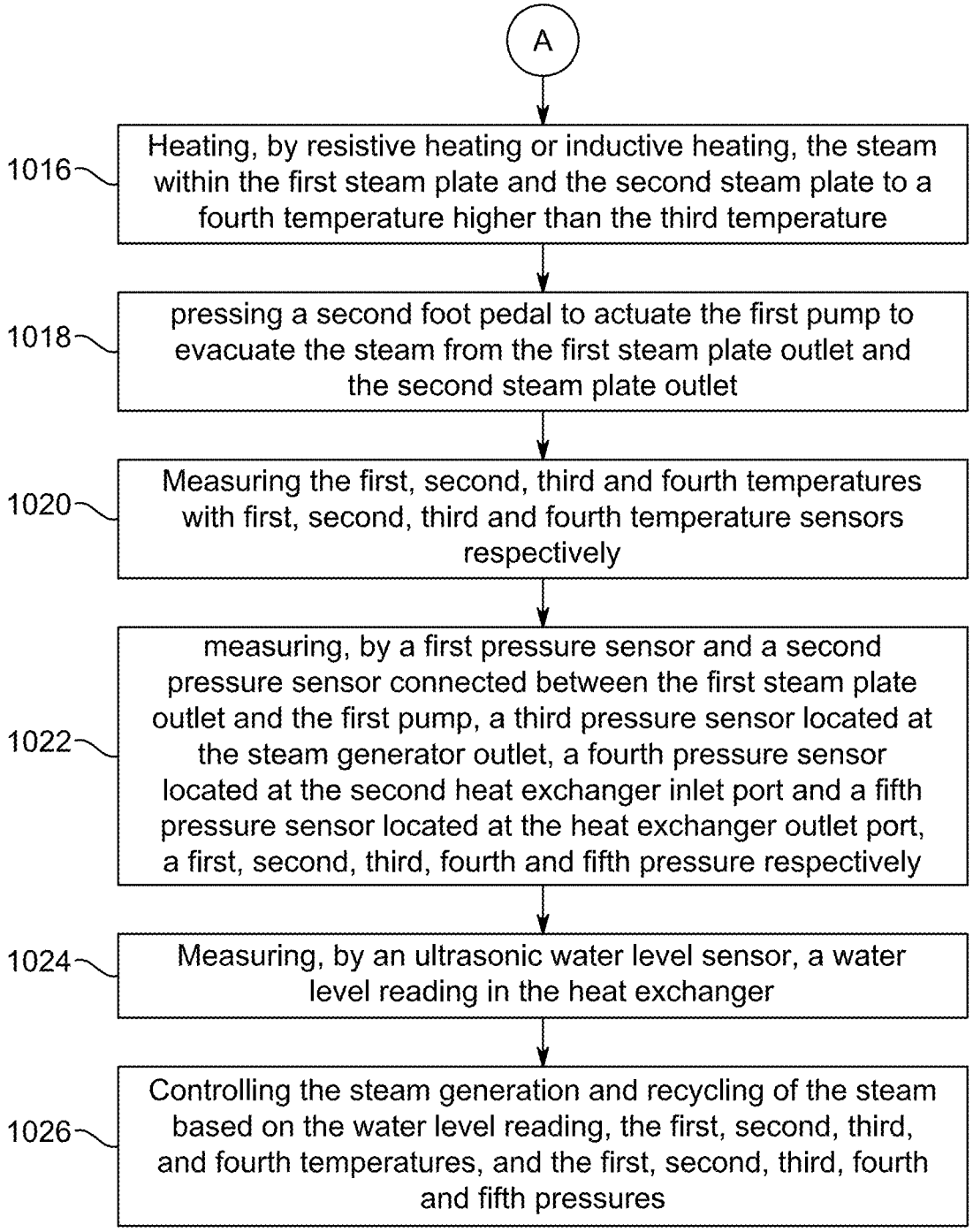

Referring to FIG. 10, a flowchart of a method 1000 of controlling steam generation in the steam press 100 is illustrated. Further, it may be appreciated that the steps described with reference to the method 1000 are only illustrative, and other alternatives may also be provided where one or more steps are re-ordered, one or more steps are added, or one or more steps are removed.

At step 1002, the method 1000 includes pumping recycled steam from the first pump 210 connected to the first steam plate outlet 110*b* and the second steam plate outlet 120*b*, into the first heat exchanger inlet port 220*a*.

At step 1004, the method 1000 includes pumping, by the second pump 230, fresh water at the first temperature, into the second heat exchanger inlet port 220*b*.

At step 1006, the method 1000 includes mixing the steam with fresh water at the first temperature in the heat exchanger 220 with the recycled steam by the swirl generator 510, generating mixed water at the second temperature higher than the first temperature.

At step 1008, the method 1000 includes pumping, by the third pump 240, the mixed water through the check valve 252 into the storage tank 250.

At step 1010, the method 1000 includes pumping, by the fourth pump 260, the mixed water from the storage tank 250 into the steam generator 270.

At step 1012, the method 1000 includes heating, by providing power to the resistive heating element 274 of the steam generator heating circuit 272 located in the steam generator 270, the mixed water at the second temperature to boiling, thus generating steam at the third temperature.

At step 1014, the method 1000 includes pressing the first foot pedal 130 to actuate the controllable pressure valve 278 located at the steam generator outlet 270*b*, to deliver the steam at the third temperature to the first steam plate inlet 110*a* and the second steam plate inlet 110*b*. At step 1016, the method 1000 includes heating, by resistive heating or inductive heating, the steam within the first steam plate 110 and the second steam plate 120 to the fourth temperature higher than the third temperature.

At step 1018, the method 1000 includes pressing the second foot pedal 132 to actuate the first pump 210 to evacuate the steam from the first steam plate outlet 110*b* and the second steam plate outlet 120*b*.

At step 1020, the method 1000 includes measuring the first, second, third and fourth temperatures with first, second, third and fourth temperature sensors 284, 294, 288, 296 respectively.

At step 1022, the method 1000 includes measuring, by the first pressure sensor 280 and the second pressure sensor 282 connected between the first steam plate outlet 110*b* and the first pump 210, the third pressure sensor 286 located at the steam generator outlet 270*b*, the fourth pressure sensor 290 located at the second heat exchanger inlet port 220*b* and the fifth pressure sensor 292 located at the heat exchanger outlet port 220*c*, a first, second, third, fourth and fifth pressure respectively.

At step 1024, the method 1000 includes measuring, by the ultrasonic water level sensor 222, a water level reading in the heat exchanger 220.

At step 1026, the method 1000 includes controlling the steam generation and recycling of the steam, by the controller 400 connected to the first, second, third and fourth temperature sensors 284, 294, 288, 296, the first, second, third, fourth and fifth pressure sensors 280, 282, 286, 290, 292, the ultrasonic water level sensor 222, the controllable pressure valve 278, and the steam generator heating circuit 272. The controller 400 includes a non-transitory computer readable medium having instructions stored therein that, when executed by one or more processors, cause the one or more processors to perform the following steps (hereinafter described to be performed by the controller 400 itself). The controller 400 monitors the water level reading in the heat exchanger 220. The controller 400 compares the water level to a water level threshold. The controller 400 monitors the first, second, third, and fourth temperatures. The controller 400 monitors the first, second, third, fourth and fifth pressures. The controller 400 compares the first, second, third, and fourth temperatures to the first set of temperature setpoint values. The controller 400 compares the first, second, third, fourth and fifth pressures to the second set of pressure setpoint values. The controller 400 generates control signals to adjust the first pump, the second pump, the third pump, the fourth pump, the controllable pressure valve, and a power supplied to the steam generator heating circuit to generate steam matching the first set of temperature setpoint values and the second set of pressure setpoint values. In particular, the controller 400 generates control signals to adjust the first pump 210, the second pump 230, the third pump 240, the fourth pump 260, the controllable pressure valve 278, and the power supplied to the steam generator heating circuit 272 to cause the first, second, third, and fourth temperatures to match the first set of temperature setpoint values and the first, second, third, fourth and fifth pressures to match the second set of pressure setpoint values. That is, the controller 400 may adjust (control) the said components to regulate the first, second, third, and fourth temperatures, and the first, second, third, fourth and fifth pressures based on the corresponding setpoint values as preset by the user.

The steam press system 100 implements the steam generator 270, with the resistive heating element 274 inserted into the steam generator 270, for boiling the water to deliver the steam to ironing station including the first steam plate 110 and the second steam plate 120. Further, the first pump 210 acts as a suction source to take out moisture and rejected steam from ironed clothes placed between the first steam plate 110 and the second steam plate 120. The heat exchanger 220 is used to exchange heat between the waste steam and the incoming fresh water to heat up the water before being passed to the steam generator 270. In the heat exchanger 220, the heat transfer takes place between the fresh water and the rejected steam, leading to increased water temperature and condensation of the steam. The free-rotating, direct-contact swirl generator 510 is designed to condense steam and heat fresh water efficiently in the heat exchanger 220. Thus, the steam press system 100 helps to recover the heat energy in the rejected steam to heat the fresh water before entering the steam generator 270, so that the pre-heated water in the steam generator 270 may require less energy to produce steam. Furthermore, the rejected steam is captured and recycled in the steam press system 100 which, in addition to lowering the energy consumption needed to heat the water, may lead to a significant reduction in water use. The steam plates 110, 120 with complementary design to include the extensions 716 and the groove 726 may help to prevent the escape of the steam to the surrounding environment, which improves the working environment of the ironing shop and reduces the required power for the air-conditioning system inside the shops. Further, water level control, temperature control and pressure control is integrated into the steam press system 100 for efficient steam generation and reclamation. Therefore, the steam press system 100 advances the performance of the prior art steam generators in providing heat and mass recovery. Such a supplementary recovery system helps in utilizing the latent and sensible heat of the waste steam to increase the inlet temperature of the fresh water and hence reduce the power consumption of the steam generator 270 and may also help to reduce its size. Moreover, the steam press system 100 also reduces the water consumption by recirculating the condensed water again to the steam generator 270.

Figure 11:
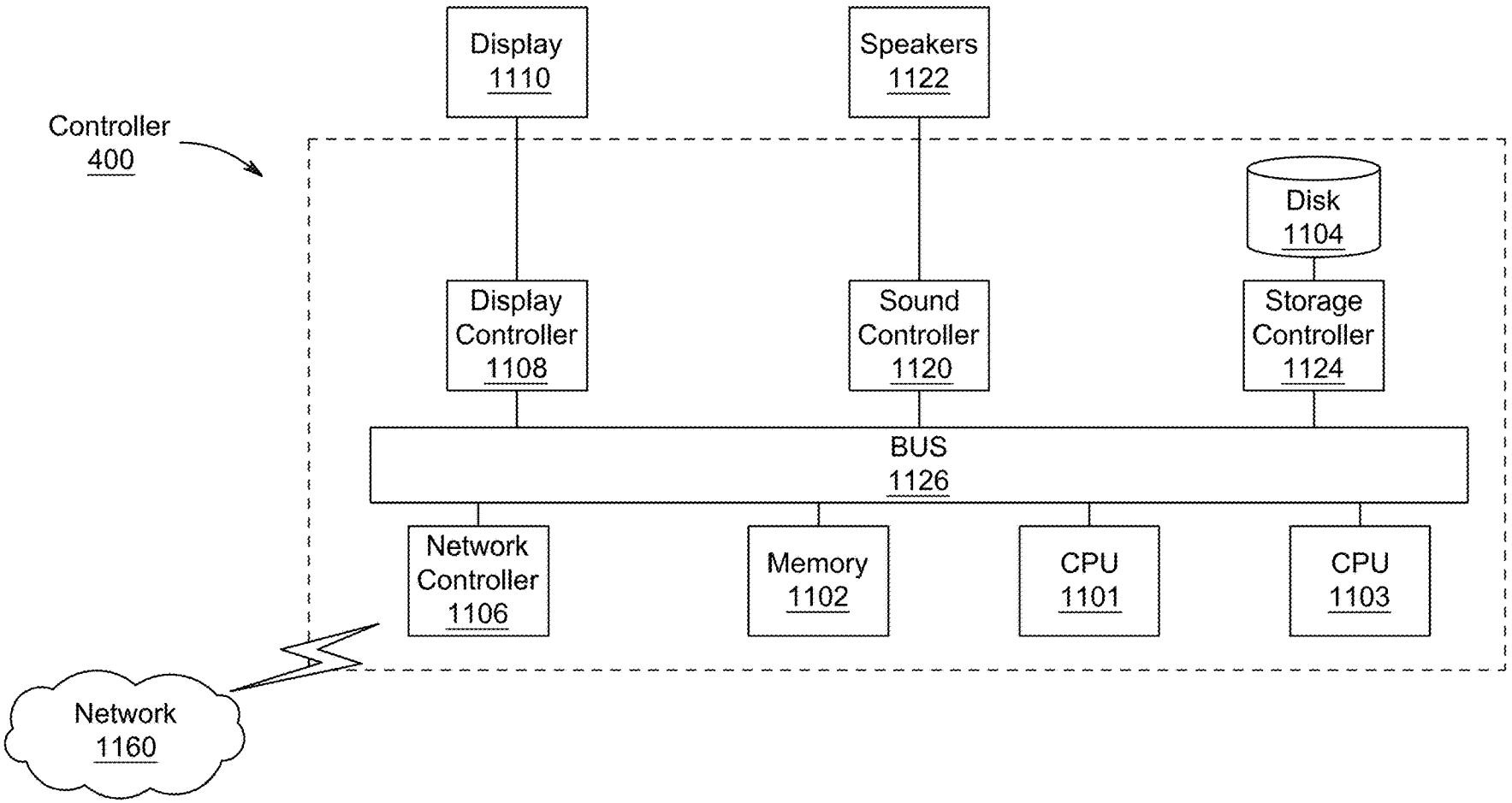
FIG. 11 is an illustration of details of computing hardware used in the controller of FIG. 4, according to certain embodiments.

Next, further details of the hardware description of the controller 400 of FIG. 4 according to exemplary embodiments is described with reference to FIG. 11. In FIG. 11, the controller 400 is embodied a computing device which includes a CPU 1101 which performs the processes described above/below. The process data and instructions may be stored in the memory 1102. These processes and instructions may also be stored on a storage medium disk 1104 such as a hard drive (HDD) or portable storage medium or may be stored remotely.

Further, the claims are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computing device communicates, such as a server or computer.

Further, the claims may be provided as a utility application, background daemon, or component of an operating system, or combination thereof, executing in conjunction with CPU 1101, 1103 and an operating system such as Microsoft Windows 7, Microsoft Windows 10, UNIX, Solaris, LINUX, Apple MAC-OS, and other systems known to those skilled in the art.

The hardware elements in order to achieve the computing device may be realized by various circuitry elements, known to those skilled in the art. For example, CPU 1101 or CPU 1103 may be a Xenon or Core processor from Intel of America or an Opteron processor from AMD of America, or may be other processor types that would be recognized by one of ordinary skill in the art. Alternatively, the CPU 1101, 1103 may be implemented on an FPGA, ASIC, PLD or using discrete logic circuits, as one of ordinary skill in the art would recognize. Further, CPU 1101, 1103 may be implemented as multiple processors cooperatively working in parallel to perform the instructions of the inventive processes described above.

The controller 400 in FIG. 11 also includes a network controller 1106, such as an Intel Ethernet PRO network interface card from Intel Corporation of America, for interfacing with network 1160. As can be appreciated, the network 1160 can be a public network, such as the Internet, or a private network such as an LAN or WAN network, or any combination thereof and can also include PSTN or ISDN sub-networks. The network 1160 can also be wired, such as an Ethernet network, or can be wireless such as a cellular network including EDGE, 3G and 4G wireless cellular systems. The wireless network can also be WiFi, Bluetooth, or any other wireless form of communication that is known.

The computing device further includes a display controller 1108, such as a NVIDIA GeForce GTX or Quadro graphics adaptor from NVIDIA Corporation of America for interfacing with display 1110, such as a Hewlett Packard HPL2445w LCD monitor.

A sound controller 1120 is also provided in the computing device such as Sound Blaster X-Fi Titanium from Creative, to interface with speakers/microphone 1122 thereby providing sounds and/or music.

The general purpose storage controller 1124 connects the storage medium disk 1104 with communication bus 1126, which may be an ISA, EISA, VESA, PCI, or similar, for interconnecting all of the components of the computing device. A description of the general features and functionality of the display 1110, the display controller 1108, storage controller 1124, network controller 1106, and the sound controller 1120 is omitted herein for brevity as these features are known.

The exemplary circuit elements described in the context of the present disclosure may be replaced with other elements and structured differently than the examples provided herein. Moreover, circuitry configured to perform features described herein may be implemented in multiple circuit units (e.g., chips), or the features may be combined in circuitry on a single chipset.

The above-described hardware description is a non-limiting example of corresponding structure for performing the functionality described herein.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A steam generation and steam recycling steam press system, comprising:

a first steam plate configured to receive steam at a first steam plate inlet and evacuate the steam through a first steam plate outlet;

a second steam plate configured to receive steam at a second steam plate inlet and evacuate the steam through a second steam plate outlet;

wherein the first steam plate includes a first inner surface which faces a second inner surface of the second steam plate, wherein the first inner surface and the second inner surface each include a pattern of evenly distributed holes having a diameter of 2 mm to 6 mm;

a first piping arrangement connected to the first steam plate outlet and the second steam plate outlet;

a first pump connected to the first piping arrangement, the first pump configured to draw steam from the first piping arrangement and expel the steam at a first pump outlet;

a heat exchanger having a first heat exchanger inlet port connected to the first pump outlet;

a second pump configured to pump fresh water at a first temperature from a freshwater source into a second heat exchanger inlet port;

wherein the heat exchanger is configured to condense the steam into the fresh water and heat the fresh water to a second temperature greater than the first temperature;

a heat exchanger outlet port configured to expel the heated water;

a third pump connected to the heat exchanger outlet port;

a storage tank inlet connected to the third pump;

a fourth pump connected to a storage tank outlet;

a steam generator having a steam generator inlet connected to the fourth pump, the steam generator configured to:

receive the heated water at the second temperature from the fourth pump, boil the heated water to generate steam at a third temperature; and deliver the steam to the first steam plate inlet and the second steam plate inlet through a second piping arrangement.

2. The steam generation and steam recycling steam press system of claim 1, the heat exchanger further comprising:

a cylindrical insulated housing;

a plurality of supports connected at each end to opposite walls of an interior of the cylindrical insulated housing, each support having a circular opening at a central location, wherein each circular opening includes a rotatable bearing;

a swirl generator inserted through the first heat exchanger inlet port and through the rotatable bearings, the swirl generator connected to the first pump outlet, the swirl generator configured to extend coaxially with a central axis of the cylindrical insulated housing; and a plurality of pipe arms located on the swirl generator, each pipe arm ending in a 90 degree bend, wherein each pipe arm is configured receive steam from the swirl generator and expel steam into the fresh water, such that a swirling flow is generated in the freshwater and rotates each pipe arm around the central axis.

3. The steam generation and steam recycling steam press system of claim 1, wherein the first piping arrangement comprises:

a first hose coupling, the first hose coupling configured with a flexible joint, the flexible joint configured to bend at an angle in the range of zero degrees to 90 degrees;

a first flexible hose connected between the first steam plate outlet and the first hose coupling;

a second hose coupling configured with a 90 degree bend;

a second flexible hose connected between the second steam plate outlet and the second hose coupling;

a third hose coupling having a T shape;

a first rigid pipe connected between a first T joint of the third hose coupling and the first hose coupling;

a second rigid pipe connected between a second T joint of the third hose coupling and the second hose coupling;

a third rigid pipe connected to a main joint of the third hose coupling;

a fourth hose coupling configured with a 90 degree bend, wherein the third rigid pipe is connected to the fourth hose coupling;

a fourth rigid pipe connected to the fourth hose coupling;

a fifth hose coupling configured with a 90 degree bend, wherein the fourth rigid pipe is connected to the fifth hose coupling;

a fifth rigid pipe connected to the fifth hose coupling;

a sixth hose coupling having a T shape, a first T joint of the sixth hose coupling connected to the fifth rigid pipe;

a sixth rigid pipe connected to a second T joint of the sixth hose coupling;

a seventh hose coupling having a T shape, a first T joint of the seventh hose coupling connected to the sixth rigid pipe;

a seventh rigid pipe connected to a second T joint of the seventh hose coupling;

an eighth hose coupling having a 90 degree bend, the eighth hose coupling connected to the seventh rigid pipe;

a third flexible hose connected between the eighth hose coupling and the first pump;

a first pressure sensor coupled to the sixth rigid pipe;

a second pressure sensor coupled to the seventh rigid pipe;

an eighth rigid pipe connected to a main joint of the sixth hose coupling;

a ninth hose coupling having a 90 degree bend;

a ninth rigid pipe connected to the ninth hose coupling;

a tenth hose coupling having a 90 degree bend, the tenth hose coupling connected to the ninth rigid pipe;

a tenth rigid pipe connected to the tenth hose coupling and a main joint of the seventh hose coupling; and a first temperature sensor coupled to the ninth rigid pipe.

4. The steam generation and steam recycling steam press system of claim 3, the second piping arrangement comprising:

an eleventh hose coupling, the eleventh hose coupling configured with a flexible joint, the flexible joint configured to bend at an angle in the range of zero degrees to 90 degrees;

a fourth flexible hose connected between the first steam plate inlet and the eleventh hose coupling;

a twelfth hose coupling configured with a 90 degree bend;

a fifth flexible hose connected between the second steam plate inlet and the twelfth hose coupling;

a thirteenth hose coupling having a T shape;

an eleventh rigid pipe connected between a first T joint of the thirteenth hose coupling and the eleventh hose coupling;

a twelfth rigid pipe connected between a second T joint of the thirteenth hose coupling and the twelfth hose coupling;

a thirteenth rigid pipe connected to a main joint of the thirteenth hose coupling;

a fourteenth hose coupling configured with a 90 degree bend, wherein the fourteenth rigid pipe is connected to the fourteenth hose coupling;

a sixth flexible hose connected between the fourteenth hose coupling and the steam generator;

a third pressure sensor coupled to the thirteenth rigid pipe; and a third temperature sensor connected to the thirteenth rigid pipe.

5. The steam generation and steam recycling steam press system of claim 4, wherein the first flexible hose, the second flexible hose, the third flexible, the fourth flexible hose, the fifth flexible hose and the sixth flexible hose are high temperature, high pressure hoses.

6. The steam generation and steam recycling steam press system of claim 1, further comprising:

an outer case, wherein the heat exchanger, the first water pump, the storage tank, and the steam generator are enclosed within the outer case;

two struts each having a first end and a second end;

wherein the first end of each strut is connected to the first steam plate;

wherein the second end of each strut is connected to the outer case by a pivot, such that the first steam plate is configured to be raised above the outer case or lowered to mate with the second steam plate;

wherein the second steam plate is rigidly fixed to the outer case;

wherein the second steam plate is below the first steam plate;

a first foot pedal configured to release steam from the steam generator; and a second foot pedal configured to operate the first pump to evacuate the steam from the first steam plate outlet and the second steam plate outlet.

7. The steam generation and steam recycling steam press system of claim 1, wherein the first inner surface and the second inner surface are made from iron.

8. The steam generation and steam recycling steam press system of claim 7, further comprising:

a first steam plate housing having the first inner surface, a top cover, and a first middle region, wherein the top cover includes extensions around its circumference which protrude past the first inner surface;

an electromagnetic coil located within the first middle region;

an alternating current circuit connected to the electromagnetic coil, wherein the electromagnetic coil generates an alternating magnetic induction field when the alternating current is applied;

a second steam plate housing having the second inner surface, a bottom cover and a second middle region, wherein the second inner surface has a groove around its circumference, the groove configured to receive the extensions of the first steam plate housing;

a permanent magnet located within the second middle region, wherein eddy currents generated in the permanent magnet due to the alternating magnetic induction field, heat the steam in both the first steam plate and the second steam plate from the third temperature to a fourth temperature greater than the third temperature.

9. The steam generation and steam recycling steam press system of claim 1, wherein the first inner surface and the second inner surface are made from one of iron, anodized aluminum, titanium alloy, stainless steel, porcelain, satin aluminum, polished aluminum, ceramic, and titanium.

10. The steam generation and steam recycling steam press system of claim 9, further comprising:

a first steam plate housing having the first inner surface, a top cover, and a first middle region, wherein the top cover including extensions around its circumference which protrude past the first inner surface;

a first resistive heater located within the first middle region;

a first resistive heating circuit connected to the first resistive heater, the first resistive heating circuit configured to increase the third temperature of the steam to a temperature setpoint value;

a second steam plate housing having the second inner surface, a bottom cover and a second middle region, wherein the second inner surface has a groove around its circumference, the groove configured to receive the extensions of the first steam plate housing;

a second resistive heater located within the second middle region; and a second resistive heating circuit connected to the second resistive heater, the second resistive heating circuit configured to increase the third temperature of the steam to the temperature setpoint value.

11. The steam generation and steam recycling steam press system of claim 1, further comprising:

a first temperature sensor connected between the first steam plate outlet and the first pump;

a third temperature sensor located at a steam generator outlet;

a first pressure sensor and a second pressure sensor connected between the first steam plate outlet and the first pump;

a third pressure sensor located at the steam generator outlet;

a fourth pressure sensor located at the second heat exchanger inlet port;

a fifth pressure sensor located at the heat exchanger outlet port;

a second temperature sensor located at the heat exchanger outlet port;

a fourth temperature sensor located in at least one of the first steam plate and the second steam plate;

a steam generator heating circuit located within the steam generator;

a check valve connected between the heat exchanger outlet port and the storage tank inlet;

a controllable pressure valve connected between the steam generator outlet and the first steam plate inlet and the second steam plate inlet;

a controller connected to the first temperature sensor, the second temperature sensor, the third temperature sensor, the fourth temperature sensor, the first pressure sensor, the second pressure sensor, the third pressure sensor, the fourth pressure sensor, the fifth pressure sensor, the controllable pressure valve, and the steam generator heating circuit, the controller including a non-transitory computer readable medium having instructions stored therein that, when executed by one or more processors, cause the one or more processors to:

monitor the first, second, third, and fourth temperatures;

monitor the first, second, third, fourth and fifth pressures;

compare the first, second, third, and fourth temperatures to a first set of temperature setpoint values;

compare the first, second, third, fourth and fifth pressures to a second set of pressure setpoint values; and generate control signals to adjust the first pump, the second pump, the third pump, the fourth pump, the controllable pressure valve, and a power supplied to the steam generator heating circuit to the first set of temperature setpoint values and the second set of pressure setpoint values.

12. The steam generation and steam recycling steam press system of claim 11, further comprising:

an outer case, wherein the heat exchanger, the first water pump, the storage tank, and the steam generator are enclosed within the outer case, wherein the outer case includes:

a first foot pedal configured to control the flow of steam from the steam generator into the first steam plate inlet and the second steam plate inlet;

a second foot pedal configured to eject the steam through the holes in the first inner surface and the second inner surface;

a temperature control switch configured to change the first set of temperature setpoint values; and a pressure control switch configured to change the second set of pressure setpoint values.

13. The steam generation and steam recycling steam press system of claim 11, wherein the steam generator heating circuit includes at least one steam generator heating element, a power switch, and a temperature control circuit, wherein the controller is configured to control the power supplied to the at least one steam generator heating element to control the temperature and pressure within the steam generator.

14. The steam generation and steam recycling steam press system of claim 11, further comprising:

a water level sensor located inside the heat exchanger, the water level sensor configured to detect a level of the water inside the heat exchanger and generate a water level reading, wherein the controller is connected to the water level sensor to receive the water level reading; and wherein the controller is configured to adjust a power supplied to the first pump based on the water level reading.

15. The steam generation and steam recycling steam press system of claim 1, wherein the storage tank is configured to store the heated water at the second temperature.

16. The steam generation and steam recycling steam press system of claim 1, further comprising:

a check valve located between the third pump and the storage tank inlet, wherein the check valve is configured to prevent backflow of the heated water from the storage tank.

* * * * *